US007707878B2

(12) United States Patent
Kanayama et al.

(10) Patent No.: US 7,707,878 B2
(45) Date of Patent: May 4, 2010

(54) CIRCULATION PUMP FOR CIRCULATING DOWNHOLE FLUIDS, AND CHARACTERIZATION APPARATUS OF DOWNHOLE FLUIDS

(75) Inventors: Kazumasa Kanayama, Kanagawa-ken (JP); Ryuki Odashima, Kanagawa-ken (JP); Shunetsu Onodera, Gloucestershire (GB); Hitoshi Sugiyama, Kanagawa-ken (JP); Hideki Kinjo, Kanagawa-ken (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 55 days.

(21) Appl. No.: 11/858,138

(22) Filed: Sep. 20, 2007

(65) Prior Publication Data

US 2009/0078412 A1 Mar. 26, 2009

(51) Int. Cl.
*E21B 47/08* (2006.01)

(52) U.S. Cl. ..... 73/152.55

(58) Field of Classification Search ..... 73/152.55
See application file for complete search history.

(56) References Cited

U.S. PATENT DOCUMENTS

| | | | |
|---|---|---|---|
| 591,262 | A | 10/1897 | Park |
| 3,762,839 | A | 10/1973 | Laing |
| 3,780,575 | A | 12/1973 | Urbanosky |
| 3,859,851 | A | 1/1975 | Urbanosky |
| 3,954,006 | A | 5/1976 | Anderson et al. |
| 4,013,384 | A | 3/1977 | Oikawa |
| 4,110,059 | A | 8/1978 | Kling |
| 4,782,695 | A | 11/1988 | Glotin et al. |
| 4,860,581 | A | 8/1989 | Zimmerman et al. |
| 4,936,139 | A | 6/1990 | Zimmerman et al. |
| 4,994,671 | A | 2/1991 | Safinya et al. |
| 5,167,149 | A | 12/1992 | Mullins et al. |
| 5,201,220 | A | 4/1993 | Mullins et al. |

(Continued)

FOREIGN PATENT DOCUMENTS

| | | |
|---|---|---|
| GB | 2362960 | 5/2001 |

(Continued)

OTHER PUBLICATIONS

Walker, I.R., "Circulation Pump for High Purity Gases at High Pressure and a Novel Linear Motor Positioning System," Rev. Sc. Instrum. 67 (2), Feb. 1996, pp. 564-578.

(Continued)

*Primary Examiner*—Hezron Williams
*Assistant Examiner*—Rodney T Frank
(74) *Attorney, Agent, or Firm*—Matthias Abrell; Jody DeStefanis; Jeff Griffin

(57) ABSTRACT

A circulation pump for circulating downhole fluids is provided. The circulation pump includes a cylindrical pump housing, a shaft secured in the pump housing extending in a longitudinal direction thereof, an impeller rotating around the shaft in the pump housing, a cylindrical magnetic coupler rotating around the pump housing, the cylindrical magnetic coupler including a magnet, and a motor positioned outside of the pump housing and connected to the magnetic coupler to rotate the magnetic coupler around the pump housing. The impeller is provided with a magnetic piece, which is capable of being magnetically connected with the magnet of the cylindrical magnetic coupler to cause the impeller to rotate around the shaft by rotating the cylindrical magnetic coupler around the pump housing.

25 Claims, 14 Drawing Sheets

U.S. PATENT DOCUMENTS

| | | | | |
|---|---|---|---|---|
| 5,266,800 | A | 11/1993 | Mullins | |
| 5,295,810 | A | 3/1994 | Heijnen | |
| 5,331,156 | A | 7/1994 | Hines | |
| 5,505,594 | A | 4/1996 | Sheehan | |
| 5,951,262 | A | 9/1999 | Hartman | |
| 6,178,815 | B1 | 1/2001 | Felling et al. | |
| 6,274,865 | B1 | 8/2001 | Schroer et al. | |
| 6,301,959 | B1 | 10/2001 | Hrametz et al. | |
| 6,343,507 | B1 | 2/2002 | Felling et al. | |
| 6,467,544 | B1 | 10/2002 | Brown et al. | |
| 6,474,152 | B1 | 11/2002 | Mullins et al. | |
| 6,476,384 | B1 | 11/2002 | Mullins et al. | |
| 6,585,045 | B2 | 7/2003 | Lee et al. | |
| 6,609,568 | B2 | 8/2003 | Krueger et al. | |
| 6,659,177 | B2 | 12/2003 | Bolze et al. | |
| 6,688,390 | B2 | 2/2004 | Bolze et al. | |
| 6,719,049 | B2 | 4/2004 | Sherwood et al. | |
| 6,755,086 | B2 | 6/2004 | Salamitou et al. | |
| 6,768,105 | B2 | 7/2004 | Mullins et al. | |
| 6,842,700 | B2 | 1/2005 | Poe | |
| 6,850,317 | B2 | 2/2005 | Mullins et al. | |
| 6,854,341 | B2 | 2/2005 | Oddie et al. | |
| 6,898,963 | B2 | 5/2005 | Irani | |
| 7,267,479 | B2 * | 9/2007 | Terentiev | 366/273 |
| 7,434,983 | B2 * | 10/2008 | Terentiev | 366/273 |
| 2002/0145940 | A1 * | 10/2002 | Terentiev | 366/273 |
| 2002/0194906 | A1 | 12/2002 | Goodwin et al. | |
| 2003/0033866 | A1 | 2/2003 | Diakonov et al. | |
| 2004/0000433 | A1 | 1/2004 | Hill et al. | |
| 2004/0000636 | A1 | 1/2004 | Mullins et al. | |
| 2004/0045706 | A1 | 3/2004 | Pop et al. | |
| 2004/0047232 | A1 * | 3/2004 | Terentiev | 366/273 |
| 2004/0218468 | A1 * | 11/2004 | Terentiev | 366/273 |
| 2005/0201201 | A1 * | 9/2005 | Terentiev | 366/273 |
| 2005/0217859 | A1 | 10/2005 | Hartman | |
| 2006/0243033 | A1 | 11/2006 | Freemark et al. | |
| 2006/0243047 | A1 | 11/2006 | Terabayashi et al. | |
| 2007/0007041 | A1 * | 1/2007 | Krueger et al. | 175/57 |
| 2007/0035736 | A1 | 2/2007 | Vannuffelen et al. | |
| 2008/0110253 | A1 * | 5/2008 | Stephenson et al. | 73/152.19 |

FOREIGN PATENT DOCUMENTS

| | | |
|---|---|---|
| GB | 2397382 | 7/2004 |
| WO | 99/45236 | 9/1999 |
| WO | 02/31476 | 4/2002 |
| WO | 2006/117604 | 11/2006 |

OTHER PUBLICATIONS

Sterner, Charles J., "Electromagnetic Pump for Circulating Gases at Low Flow Rates," Rev. Sc. Instruments, Oct. 1960, vol. 31, Issue 10, pp. 1159-1160.

Canfield, F.B. et al., "Electromagnetic Gas Pump for Low Temperature Service," Rev. Sci. Instrum. 34, 1431 (1963), pp. 1431-1433.

Erdman, K.L. et al., "Simple Gas Circulation Pump," Rev. Sci. Instrum. 35, 241 (1964), p. 241.

Lloyd, R.V. et al., "EPR Cavity for Oriented Single Crystals in Sealed Tubes," Rev. Sci. Instrum. 40, 514 (1969), pp. 514-515.

Mohamed, W.M. et al., "Simple High-Speed Circulating Pump for Gases," Rev. Sci. Instrum. 60 (7), Jul. 1989, pp. 1349-1350.

Duncan, S. et al., "A Double-Acting All-Glass Gas Circulating Pump," J. Sci. Instrum., 1967, vol. 44, p. 388.

Ellis, T., "A Demountable Glass Circulating Pump," J. Sci. Instrum., 1962,vol. 39, pp. 234-235.

Kallo, D. et al., "Circulating Pump and Flowmeter for Kinetic Reaction Apparatus," J. Sci. Instrum., 1964, vol. 41, pp. 338-340.

* cited by examiner

CIRCULATION PUMP FOR CIRCULATING DOWNHOLE FLUIDS, AND CHARACTERIZATION APPARATUS OF DOWNHOLE FLUIDS

CROSS REFERENCE TO RELATED APPLICATIONS

This application is related to co-pending and commonly owned U.S. patent application Ser. No. 11/203,932, filed Aug. 15, 2005, entitled "Methods and Apparatus of Downhole Fluid Analysis", the entire contents of which are incorporated herein by reference.

FIELD OF THE INVENTION

The present invention relates to the field of analysis of downhole fluids of a geological formation for evaluating and testing the formation for purposes of exploration and development of hydrocarbon-producing wells, such as oil or gas wells. More particularly, the present invention is directed to a circulation pump for circulating downhole fluids, and a characterization apparatus of downhole fluids including the circulation pump.

BACKGROUND

Downhole fluid analysis is an important and efficient investigative technique typically used to ascertain characteristics and nature of geological formations having hydrocarbon deposits. In this, typical oilfield exploration and development includes downhole fluid analysis for determining petrophysical, mineralogical, and fluid properties of hydrocarbon reservoirs. Fluid characterization is integral to an accurate evaluation of the economic viability of a hydrocarbon reservoir formation.

Typically, a complex mixture of fluids, such as oil, gas, and water, is found downhole in reservoir formations. The downhole fluids, which are also referred to as formation fluids, have characteristics, including pressure, temperature, volume, among other fluid properties, that determine phase behavior of the various constituent elements of the fluids. In order to evaluate underground formations surrounding a borehole, it is often desirable to obtain samples of formation fluids in the borehole for purposes of characterizing the fluids, including composition analysis, fluid properties and phase behavior. Wireline formation testing tools are disclosed, for example, in U.S. Pat. Nos. 3,780,575 and 3,859,851, and the Reservoir Formation Tester (RET) and Modular Formation Dynamics Tester (MDT) of Schlumberger are examples of sampling tools for extracting samples of formation fluids from a borehole for surface analysis.

Formation fluids under downhole conditions of composition, pressure and temperature typically are different from the fluids at surface conditions. For example, downhole temperatures in a well could range from 300° F. When samples of downhole fluids are transported to the surface, change in temperature of the fluids tends to occur, with attendant changes in volume and pressure. The changes in the fluids as a result of transportation to the surface cause phase separation between gaseous and liquid phases in the samples, and changes in compositional characteristics of the formation fluids.

Techniques also are known to maintain pressure and temperature of samples extracted from a well so as to obtain samples at the surface that are representative of downhole formation fluids. In conventional systems, samples taken downhole are stored in a special chamber of the formation tester tool, and the samples are transported to the surface for laboratory analysis. During sample transfer from below surface to a surface laboratory, samples often are conveyed from one sample bottle or container to another bottle or container, such as a transportation tank. In this, samples may be damaged during the transfer from one vessel to another.

Furthermore, sample pressure and temperature frequently change during conveyance of the samples from a wellsite to a remote laboratory despite the techniques used for maintaining the samples at downhole conditions. The sample transfer and transportation procedures currently in use are known to damage or spoil formation fluid samples by bubble formation, solid precipitation in the sample, among other difficulties associated with the handling of formation fluids for surface analysis of downhole fluid characteristics.

In addition, laboratory analysis at a remote site is time consuming. Delivery of sample analysis data takes anywhere from a couple of weeks to months for a comprehensive sample analysis. This hinders the ability to satisfy users' demand for real-time results and answers (i.e., answer products). Typically, the time frame for answer products relating to surface analysis of formation fluids is a few months after a sample has been sent to a remote laboratory.

As a consequence of the shortcomings in surface analysis of formation fluids, recent developments in downhole fluid analysis include techniques for characterizing formation fluids downhole in a wellbore or borehole. In this, the MDT may include one or more fluid analysis modules, such as the composition fluid analyzer (CFA) and live fluid analyzer (LFA) of Schlumberger, for example, to analyze downhole fluids sampled by the tool while the fluids are still located downhole.

In downhole fluid analysis modules of the type described above, formation fluids that are to be analyzed downhole flow past a sensor module associated with the fluid analysis module, such as a spectrometer module, which analyzes the flowing fluids by infrared absorption spectroscopy, for example. In this, an optical fluid analyzer (OFA), which may be located in the fluid analysis module, may identify fluids in the flow stream and quantify the oil and water content. U.S. Pat. No. 4,994,671 (incorporated herein by reference in its entirety) describes a borehole apparatus having a testing chamber, a light source, a spectral detector, a database, and a processor. Fluids drawn from the formation into the testing chamber are analyzed by directing the light at the fluids, detecting the spectrum of the transmitted and/or backscattered light, and processing the information (based on information in the database relating to different spectra), in order to characterize the formation fluids.

In addition, U.S. Pat. Nos. 5,167,149 and 5,201,220 (both incorporated herein by reference in their entirety) describe apparatus for estimating the quantity of gas present in a fluid stream. A prism is attached to a window in the fluid stream and light is directed through the prism to the window. Light reflected from the window/fluid flow interface at certain specific angles is detected and analyzed to indicate the presence of gas in the fluid flow.

As set forth in U.S. Pat. No. 5,266,800 (incorporated herein by reference in its entirety), monitoring optical absorption spectrum of fluid samples obtained over time may allow one to determine when formation fluids, rather than mud filtrates, are flowing into the fluid analysis module. Further, as described in U.S. Pat. No. 5,331,156 (incorporated herein by reference in its entirety), by making optical density (OD)

measurements of the fluid stream at certain predetermined energies, oil and water fractions of a two-phase fluid stream may be quantified.

On the other hand, samples extracted from downhole are analyzed at a surface laboratory by utilizing a pressure and volume control unit (PVCU) that is operated at ambient temperature and heating the fluid samples to formation conditions. However, a PVCU that is able to operate with precision at high downhole temperature conditions is not currently available. Conventional apparatuses for changing the volume of fluid samples under downhole conditions use hydraulic pressure with one attendant shortcoming that it is difficult to precisely control the stroke and speed of the piston under the downhole conditions due to oil expansion and viscosity changes that are caused by the extreme downhole temperatures. Furthermore, oil leakages at O-ring seals are experienced under the high downhole pressures requiring excessive maintenance of the apparatus.

Conventionally, a linear stroke piston type pump has been used for the described application. However, this kind of pump has several disadvantages when used for the downhole fluids. The linear stroke piston pump is big and requires a very powerful motor with ball pumping screw and valves. The dead volume of the linear stroke piston type pump is very big, and it requires a dynamic pressure seal on the pistons. Further, the pump of this type contributes to volume changes in the pumped fluids. In addition, when this pump stops, the fluid is prevented from passing through. In other words, unless the pump functions, the fluid sample cannot be introduced into the looped flowline. Further, if the pump does not function, it takes a long time to change a first sample of a first measurement point to a second sample of another measurement point by purging the first sample out from the looped flowline. As a result, two samples are mixed, and measurement error may occur when the purging time is not sufficient.

Further, a gear pump may be used for the above application. However, the size of the gear pump is big, and the dead volume is also big because of the size of the gears. If a small amount of sand is present in the fluid, the sand sticks between the gears and damages them or stops their rotation. Similarly, to the linear stroke piston pump, the fluid cannot flow through the gear pump when it is not operational.

A PCP (progressive cavity pump) is also known in the art. This pump is used as a downhole production pump. This pump may not stick due to sand contamination. PCP is a robust and reliable pump in oil field operations that does not get clogged by sand. However, a PCP stator is made with elastic material (typically rubber). This is not suitable for use in quick pressure change circuits such as bubble point detectors. This has high reverse flow impedance. To get large flow rate, a large rotator is required.

FIG. 15 shows an example of the structure of a centrifuge magnetic coupling pump. The centrifuge magnetic coupling pump 300 includes a housing 301, an impeller 304, a shaft 306, an inside magnet 308, an outside magnet 310 and a motor 312. The housing 301 includes an inlet 302 from which fluids 314 are introduced and an outlet 303 from which the fluids 314 are discharged. The impeller 304, the shaft 306 and the inside magnet 308 are provided in the housing 301. The impeller 304 is provided at one end of the shaft 306 and the inside magnet 308 is provided around the shaft such that inside magnet 308 and the impeller 304 rotate with the shaft 306. The outside magnet 310 is provided outside the housing 301 to face the inside magnet 308. The outside magnet 310 is connected to the motor 312 to be rotated by the motor 312. When the outside magnet 310 is rotated by the motor 312, the inside magnet 308 follows the outside magnet 310 to rotate the shaft 306 and the impeller 304 therewith. With this function, the fluid 314 is introduced from the inlet 302 and discharged from the outlet 303. This pump has capability of large flow rate, but the pump itself requires dead fluid volume. Further, reverse flow impedance is dependent on the gap between the impeller 304 and the housing. The housing section around the impeller 304 has to have a much larger diameter than the intake line diameter because this pump uses centrifuge force. Therefore, housing thickness has to be increased. As described above, conventionally, there have been problems in finding a proper circulation pump to be used for circulating downhole fluids

SUMMARY OF THE INVENTION

In consequence of the background discussed above, and other factors that are known in the field of downhole fluid analysis, applicants discovered methods and apparatus for downhole analysis of formation fluids by isolating the fluids from the formation and/or borehole in a flowline of a fluid analysis module. In preferred embodiments of the invention, the fluids are isolated with a pressure and volume control unit (PVCU) that is integrated with the flowline and characteristics of the isolated fluids are determined utilizing, in part, the PVCU.

The applicants further discovered that when the isolated fluid sample is circulated in a closed loop line, accuracy of phase behavior measurements can be improved. Therefore, in order to circulate the sample in a closed loop line, a circulation pump is provided in the flowline of the apparatus.

According to one aspect of the present invention, there is provided a circulation pump for circulating downhole fluids, including a cylindrical pump housing through which the fluids flow in a longitudinal direction thereof; a shaft which is fixed in the pump housing to extend in the longitudinal direction of the cylindrical pump housing; an impeller having a through hole at its center through which the shaft is inserted and capable of rotating around the shaft in the pump housing; a cylindrical magnetic coupler having a through hole at its center through which the pump housing is inserted and capable of rotating around the pump housing, the cylindrical magnetic coupler including a magnet; and a motor provided outside of the pump housing and connected to the magnetic coupler to rotate the magnetic coupler around the pump housing, wherein the impeller is provided with a magnetic piece which is capable of being magnetically connected with the magnet of the cylindrical magnetic coupler to have the impeller rotate around the shaft by rotating the cylindrical magnetic coupler around the pump housing.

This structure can minimize the size of the circulation pump. Furthermore, even when the circulation pump is not operated, the fluids can pass through the flowline. In other words, even when the pump does not function, the fluid sample can be introduced into the looped flowline. Thus, two samples are not mixed when a first sample of a first measurement point is changed to a second sample of another second measurement point by purging the first sample out from the looped flowline. Therefore, the problem that happens when the samples are to be changed as described for the linear stroke piston type pump can be prevented. Further, the circulation pump (both inside and outside of the flowline) can be cleaned and maintained easily.

In addition, the circulation pump of the present invention is an axis flow type pump. As for the axis flow type pump, reverse flow impedance becomes smaller than that of the centrifuge magnetic coupling pump. With the reverse flow, fluids are easily and effectively filled in the housing.

Additional advantages and novel features of the invention will be set forth in the description which follows or may be learned by those skilled in the art through reading the materials herein or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain principles of the present invention.

Figure 1:
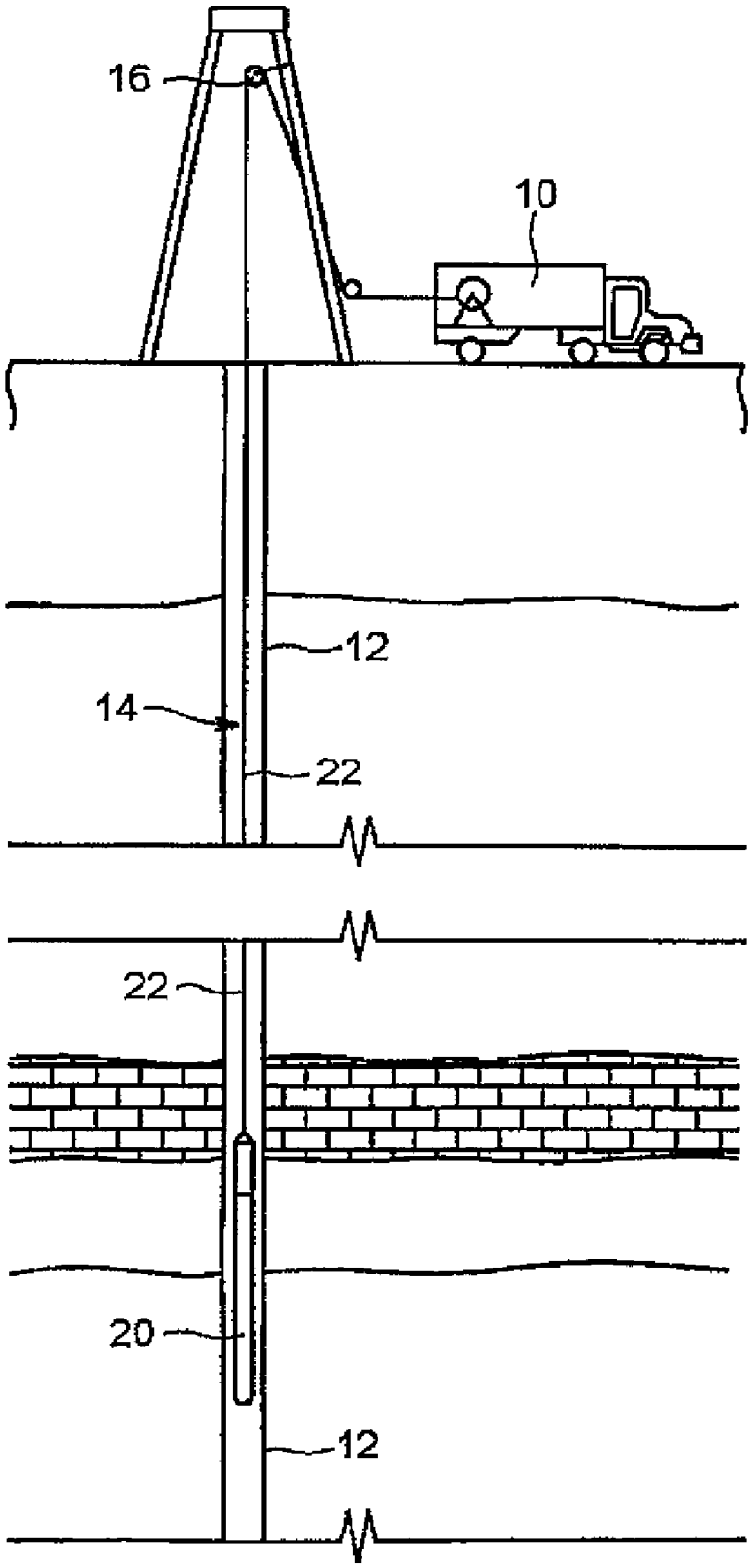
FIG. 1 is a schematic representation in cross-section of an exemplary operating environment of the present invention.

Throughout the drawings, identical reference numbers indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION

Illustrative embodiments and aspects of the invention are described below. In the interest of clarity, not all features of an actual implementation are described in the specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having benefit of the disclosure herein.

The present invention is applicable to oilfield exploration and development in areas such as down hole fluid analysis using one or more fluid analysis modules in Schlumberger's Modular Formation Dynamics Tester (MDT), for example.

FIG. 1 is a schematic representation in cross-section of an exemplary operating environment of the present invention wherein a service vehicle 10 is situated at a wellsite having a borehole or wellbore 12 with a borehole tool 20 suspended therein at the end of a wireline 22. FIG. 1 depicts one possible setting for utilization of the present invention and other operating environments also are contemplated by the present invention. Typically, the borehole 12 contains a combination of fluids such as water, mud filtrate, formation fluids, etc. The borehole tool 20 and wireline 22 typically are structured and arranged with respect to the service vehicle 10 as shown schematically in FIG. 1, in an exemplary arrangement.

Figure 2:
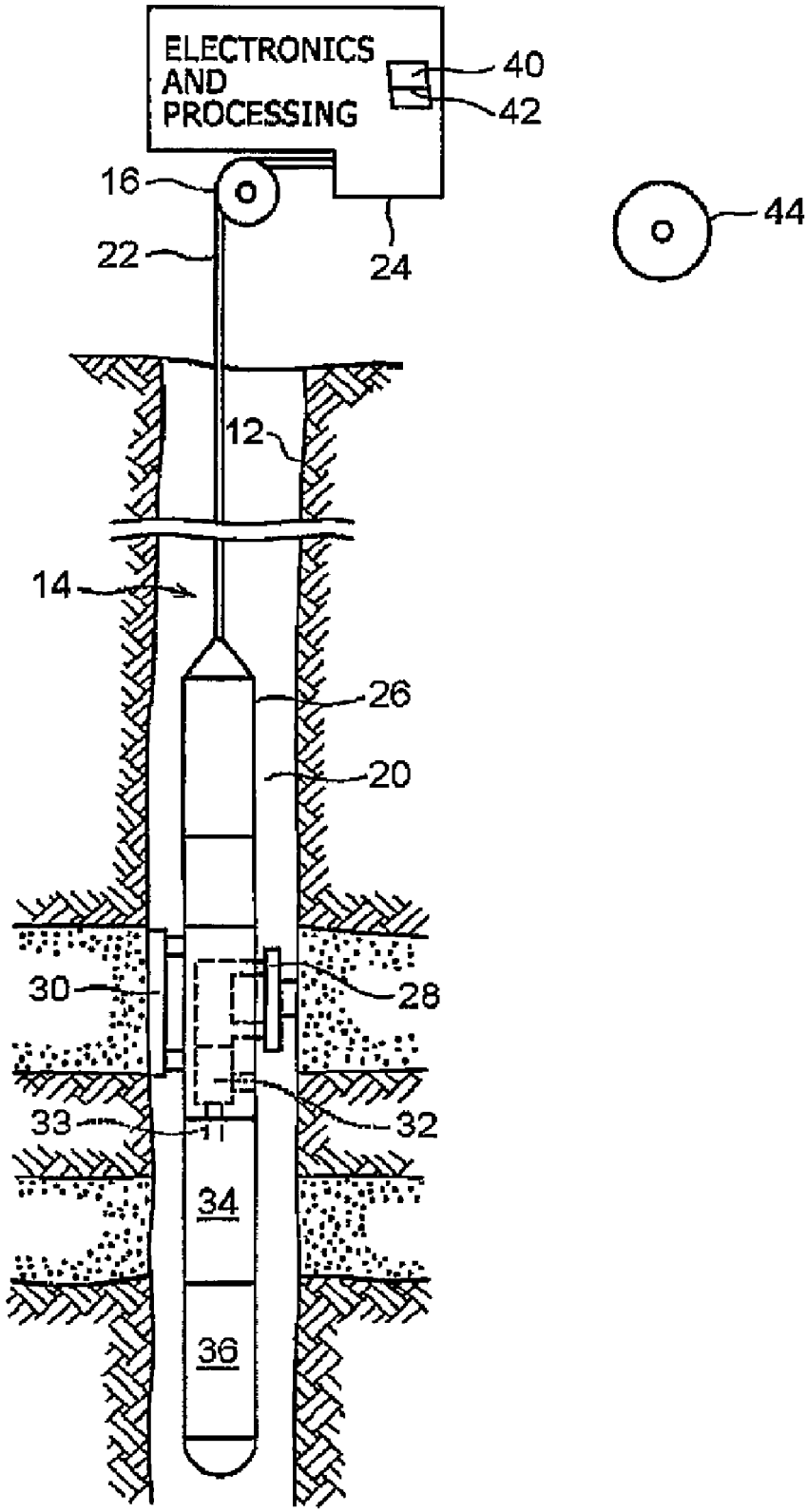
FIG. 2 is a schematic representation of one embodiment of a system for downhole analysis of formation fluids according to the present invention with an exemplary tool string deployed in a wellbore.

FIG. 2 is an exemplary embodiment of a system 14 for downhole analysis and sampling of formation fluids according to the preferred embodiments of the present invention, for example, while the service vehicle 10 is situated at a wellsite (note FIG. 1). In FIG. 2, a borehole system 14 includes a borehole tool 20, which may be used for testing earth formations and analyzing the composition of fluids from a formation. The borehole tool 20 typically is suspended in the borehole 12 (note also FIG. 1) from the lower end of a multiconductor logging cable or wireline 22 spooled on a winch 16 (note again FIG. 1) at the formation surface. The logging cable 22 typically is electrically coupled to a surface electrical control system 24 having appropriate electronics and processing systems for the borehole tool 20.

Figure 3:
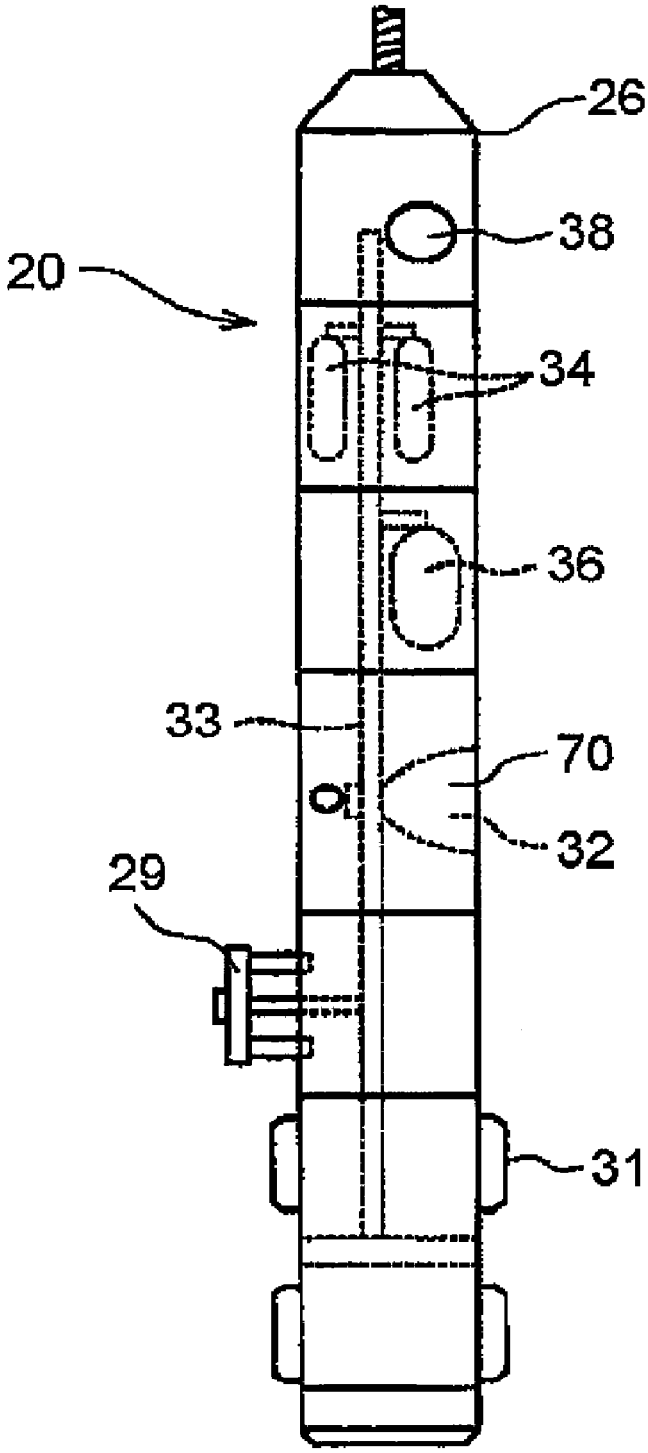
FIG. 3 shows schematically one preferred embodiment of a tool string according to the present invention with a fluid analysis module having a pressure and volume control unit (PVCU) for downhole analysis of formation fluids.

Referring also to FIG. 3, the borehole tool 20 includes an elongated body 26 encasing a variety of electronic components and modules, which are schematically represented in FIGS. 2 and 3, for providing necessary and desirable functionality to the borehole tool 20. A selectively extendible fluid admitting assembly 28 and a selectively extendible tool-anchoring member 30 (note FIG. 2) are respectively arranged on opposite sides of the elongated body 26. Fluid admitting assembly 28 is operable for selectively sealing off or isolating selected portions of a borehole wall 12 such that pressure or fluid communication with adjacent earth formation is established. The fluid admitting assembly 28 may be a single probe module 29 (depicted in FIG. 3) and/or a packer module 31 (also schematically represented in FIG. 3). Examples of borehole tools are disclosed in the aforementioned U.S. Pat. Nos. 3,780,575 and 3,859,851, and in U.S. Pat. No. 4,860,581, the contents of which are incorporated herein by reference in their entirety.

One or more fluid analysis modules 32 are provided in the tool body 26. Fluids obtained from a formation and/or borehole flow through a flowline 33, via the fluid analysis module or modules 32, and then may be discharged through a port of a pumpout module 38 (note FIG. 3). Alternatively, formation fluids in the flowline 33 may be directed to one or more fluid collecting chambers 34 and 36, such as 1, 2¾, or 6 gallon sample chambers and/or six 450 cc multi-sample modules, for receiving and retaining the fluids obtained from the formation for transportation to the surface. Examples of the fluid analysis modules 32 are disclosed in U.S. Patent Application Publications Nos. 2006/0243047A1 and 2006/0243033A1, both incorporated herein by reference in their entirety.

The fluid admitting assemblies, one or more fluid analysis modules, the flow path and the collecting chambers, and other operational elements of the borehole tool 20, are controlled by electrical control systems, such as the surface electrical control system 24 (note FIG. 2). Preferably, the electrical control system 24, and other control systems situated in the tool body 26, for example, include processor capability for characterization of formation fluids in the tool 20, as described in more detail below.

The system 14 of the present invention, in its various embodiments, preferably includes a control processor 40 operatively connected with the borehole tool 20. The control processor 40 is depicted in FIG. 2 as an element of the electrical control system 24. Preferably, the methods of the present invention are embodied in a computer program that runs in the processor 40 located, for example, in the control system 24. In operation, the program is coupled to receive data, for example, from the fluid analysis module 32, via the wireline cable 22, and to transmit control signals to operative elements of the borehole tool 20.

The computer program may be stored on a computer usable storage medium 42 associated with the processor 40, or may be stored on an external computer usable storage medium 44 and electronically coupled to processor 40 for use as needed. The storage medium 44 may be any one or more of presently known storage media, such as a magnetic disk fitting into a disk drive, or an optically readable CD-ROM, or a readable device of any other kind, including a remote storage device coupled over a switched telecommunication link, or future storage media suitable for the purposes and objectives described herein.

In some embodiments of the present invention, the methods and apparatus disclosed herein may be embodied in one or more fluid analysis modules of Schlumberger's formation tester tool, the Modular Formation Dynamics Tester (MDT). The present invention advantageously provides a formation tester tool, such as the MDT, with enhanced functionality for the downhole characterization of formation fluids and the collection of formation fluid samples. In this, the formation tester tool may advantageously be used for sampling formation fluids in conjunction with downhole characterization of the formation fluids.

Figure 4:
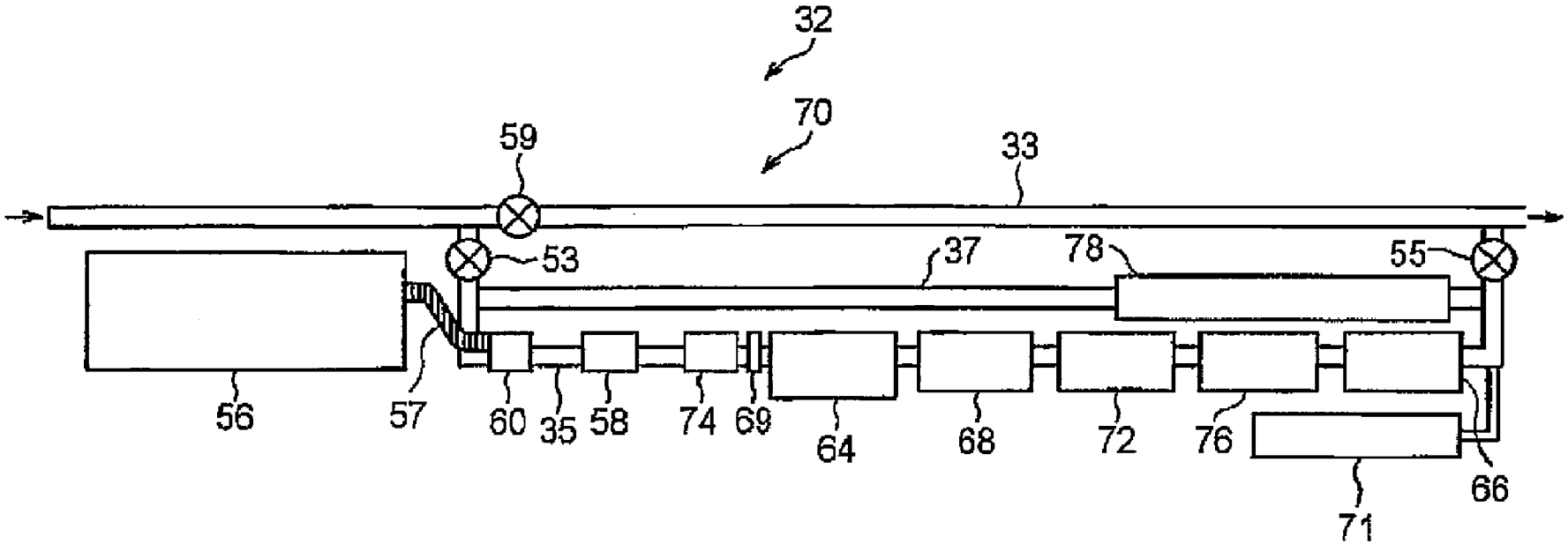
FIG. 4 schematically represents an example of a fluid analysis module with a pressure and volume control unit (PVCU) apparatus according to one embodiment for downhole characterization of fluids by isolating the formation fluids.

FIG. 4 schematically represents an example of a fluid analysis module 32 with a pressure and volume control unit (PVCU) apparatus 70 according to the present embodiment for downhole characterization of fluids by isolating the formation fluids (note FIG. 3).

In preferred embodiments, the PVCU apparatus 70 may be integrated with the flowline 33 of the module 32. The apparatus 70 includes a bypass flowline 35 and a circulation flowline 37 in fluid communication, via main flowline 33, with a formation surrounding a borehole. In one preferred embodiment, the apparatus 70 includes two seal valves 53 and 55 operatively associated with the bypass flowline 35. The valves 53 and 55 are situated so as to control the flow of formation fluids in the bypass flowline segment 35 of the main flowline 33 and to isolate formation fluids in the bypass flowline 35 between the two valves 53 and 55. A valve 59 may be situated on the main flowline 33 to control fluid flow in the main flowline 33. For example, each of the seal valves 53 and 55 may have an electrically operated DC brushless motor or stepping motor with an associated piston arrangement for opening and closing the valve. The seal valves 53 and 55 may be replaced with any suitable flow control device, such as a pump, valve, or other mechanical and/or electrical device, for starting and stopping flow of fluids in the bypass flowline 35. Moreover, combinations of devices may be utilized as necessary or desirable for the practice of the present invention.

One or more optical sensors, such as a 36-channels optical spectrometer 56, connected by an optical fiber bundle 57 with an optical cell or refractometer 60, and/or a fluorescence/refraction detector 58, may be arranged on the bypass flowline 35, to be situated between the valves 53 and 55. The optical sensors may advantageously be used to characterize fluids flowing through or retained in the bypass flowline 35. U.S. Pat. Nos. 5,331,156 and 6,476,384, and U.S. Patent Application Publication No. 2004/0000636A1 (all incorporated herein by reference in their entirety) disclose methods of characterizing formation fluids.

A pressure/temperature gauge 64 and/or a resistance sensor 74 also may be provided on the bypass flowline 35 to acquire fluid electrical resistance, pressure and/or temperature measurements of fluids in the bypass flowline 35 between seal valves 53 and 55. A chemical sensor 69 may be provided to measure characteristics of the fluids, such as CO2, H2S, pH, among other chemical properties. An ultra sonic transducer 66 and/or a density and viscosity sensor (vibrating rod) 68 also may be provided to measure characteristics of formation fluids flowing through or captured in the bypass flowline 35 between the valves 53 and 55. U.S. Pat. No. 4,860,581, incorporated herein by reference in its entirety, discloses apparatus for fluid analysis by downhole fluid pressure and/or electrical resistance measurements. U.S. Pat. No. 6,758,090 and Patent Application Publication No. 2002/0194906A1 (both incorporated herein by reference in their entirety) disclose methods and apparatus of detecting bubble point pressure and MEMS based fluid sensors, respectively.

A pump unit 71, such as a syringe-pump unit, may be arranged with respect to the bypass flowline 35 to control volume and pressure of formation fluids retained in the bypass flowline 35 between the valves 53 and 55.

Figure 5:
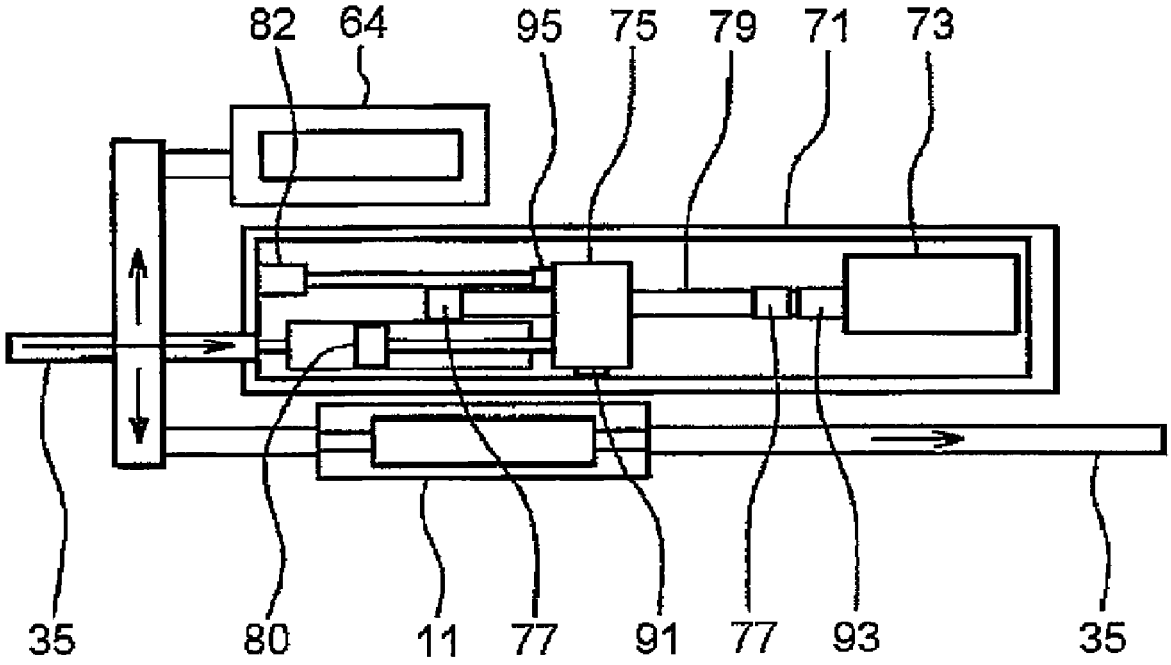
FIG. 5 is a schematic depiction of a PVCU apparatus with an array of sensors in a fluid analysis module according to one embodiment of the present invention.

FIG. 5 shows the structure of the pump unit 71. The sensors such as the spectrometer 56, the chemical sensor 69, the density and viscosity sensor 68, and the like are simply shown as the numeral 11.

The pump unit 71 has an electrical DC stepping/pulse motor with a gear to decrease the effect of backlash; ball screw 79; piston and sleeve arrangement 80 with an O-ring (not shown); a linear position sensor 82; motor-ball screw coupling 93; ball screw bearings 77; and a block 75 connecting the ball screw 79 with the piston 80. Advantageously, the PVCU apparatus 70 and the pump unit 71 are operable at high temperatures up to 200 degrees C. The section of the bypass flowline 35 with an inlet valve (not shown) is directly connected with the pump unit 71 to reduce the dead volume of the isolated formation fluid. In this, by situating the piston 80 of the pump unit 71 along the same axial direction as the bypass flowline 35, the dead volume of the isolated fluids is reduced since the volume of fluids left in the bypass flowline 34 from previously sampled fluids affects the fluid properties of subsequently sampled fluids.

To decrease motor backlash a 1/160 reducer gear may be utilized and to precisely control position of the piston 80 a DC stepping motor with a 1.8 degree pulse may be utilized. The axis of the piston 80 may be off-set from the axis of the ball screw 79 and the motor 73 so that total tool length is minimized.

In operation, rotational movement of the motor 73 is transferred to the axial displacement of the piston 80 through the ball screw 79 with a guide key 91. Change in volume may be determined by the displacement value of the piston 80, which may be directly measured by an electrical potentiometer 82, for example, while precisely and changeably controlling rotation of the motor 73, with one pulse of 1.8 degrees, for example. The electrical DC pulse motor 73 can change the volume of formation fluids retained in the flowline by actuating the piston 80, connected to the motor 73, by way of control electronics using position sensor signals. Since one preferred embodiment of the invention includes a pulsed motor and a high-resolution position sensor, the operation of the PVCU can be controlled with a high level of accuracy. The volume change is calculated by a surface area of the piston times the traveling distance recorded by a displacement or linear position sensor, such as a potentiometer, which is operatively connected with the piston. During the volume change, several sensors, such as pressure, temperature, chemical and density sensors and optical sensors, may measure the properties of the captured fluid sample.

The electrical motor 73 may be actuated for changing the volume of the isolated fluids. The displacement position of the piston 80 may be directly measured by the position sensor 82, fixed via a nut joint 95 and block 75 with the piston 80, while pulse input to the motor 73 accurately control the traveling speed and distance of the piston 80. The PVCU 70 is configured based on the desired motor performance required by the downhole environmental conditions, the operational time, the reducer and the pitch of the ball screw 79. After fluid characterization measurements are completed by the sensors and measurement devices of the module 32, the piston 80 is returned back to its initial position and the seal valves 52 and 54 are opened so that the PVCU 70 is ready for another operation.

An imager 72, such as a CCD camera, may be provided on, the bypass flowline 35 for spectral imaging to characterize phase behavior of downhole fluids isolated therein, as disclosed in co-pending U.S. patent application Ser. No. 11/204,134, titled "Spectral Imaging for Downhole Fluid Characterization," filed on Aug. 15, 2005.

A scattering detector system 76 may be provided on the bypass flowline 35 to detect particles, such as asphaktene, bubbles, oil mist from gas condensate, that come out of isolated fluids in the bypass flowline 35.

Figure 6:
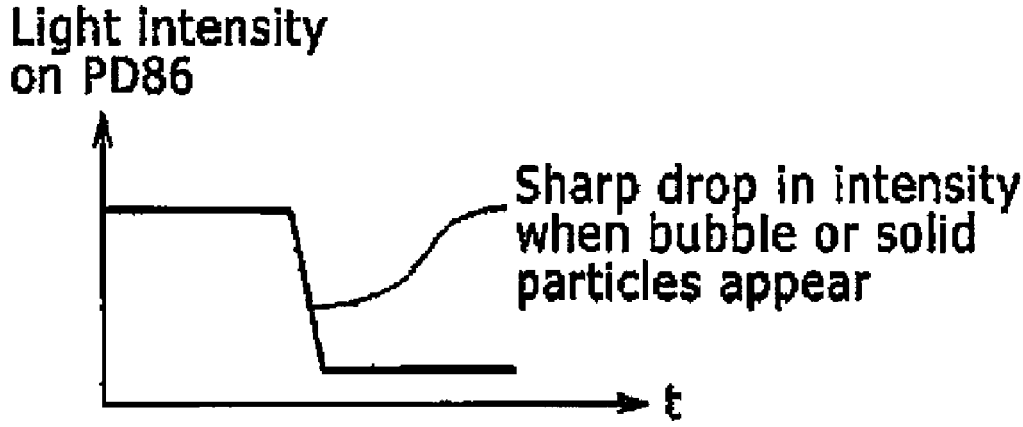
FIG. 6 is a schematic representation of a scattering detector system of the PVCU apparatus according to one embodiment of the present invention.
Figure 6:
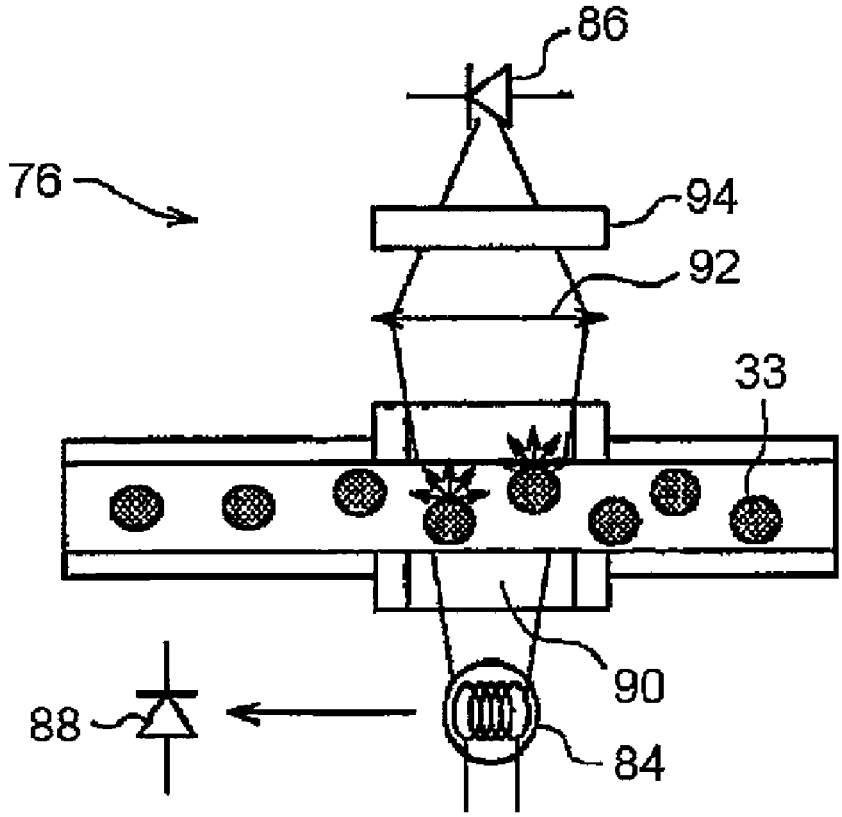

FIG. 6 is a schematic representation of a scattering detector system of the apparatus 70 according to one embodiment of the present invention. Advantageously, the scattering detector 76 may be used for monitoring phase separation by bubble point detection as graphically represented in FIG. 6.

The scattering detector 76 includes a light source 84, a first photodetector 86 and, optionally, a second photodetector 88. The second photodetector 88 may be used to evaluate intensity fluctuation of the light source 84 to confirm that the variation or drop in intensity is due to formation of bubbles or solid particles in the formation fluids that are being examined. The light source 84 may be selected from a halogen source, an LED, a laser diode, among other known light sources suitable for the purposes of the present invention.

The scattering detector 76 also includes a high-temperature high-pressure sample cell 90 with windows so that light from the light source 84 passes through formation fluids flowing through or retained in the flowline 33 to the photodetector 86 on the other side of the flowline 33 from the light source 84. Suitable collecting optics 92 may be provided between the light source 84 and the photodetector 86 so that light from the light source 84 is collected and directed to the photodetector 86. Optionally, an optical filter 94 may be provided between the optics 92 and the photodetector 86. In this, since the scattering effect is particle size dependent, i.e., maximum for wavelengths similar to or lower than the particle sizes, by selecting suitable wavelengths using the optical filter 94 it is possible to obtain suitable data on bubble/particle sizes.

Referring again to FIG. 4, a circulation pump 78 is provided on the circulation flowline 37. Since the circulation flowline 37 is a loop flowline of the bypass flowline 35, the circulation pump 78 may be used to circulate formation fluids that are isolated in the bypass flowline 35 in a loop formed by the bypass flowline 35 and the circulation flowline 37.

The bypass flowline 35 is looped, via the circulation flowline 37, and the circulation pump 78 is provided on the looped flowline 35 and 37 so that formation fluids isolated in the bypass flowline 35 may be circulated, for example, during phase behavior characterization. When the isolated fluid sample in the bypass flowline 35 is circulated in a closed loop line, accuracy of phase behavior measurements can be improved.

Figure 7:
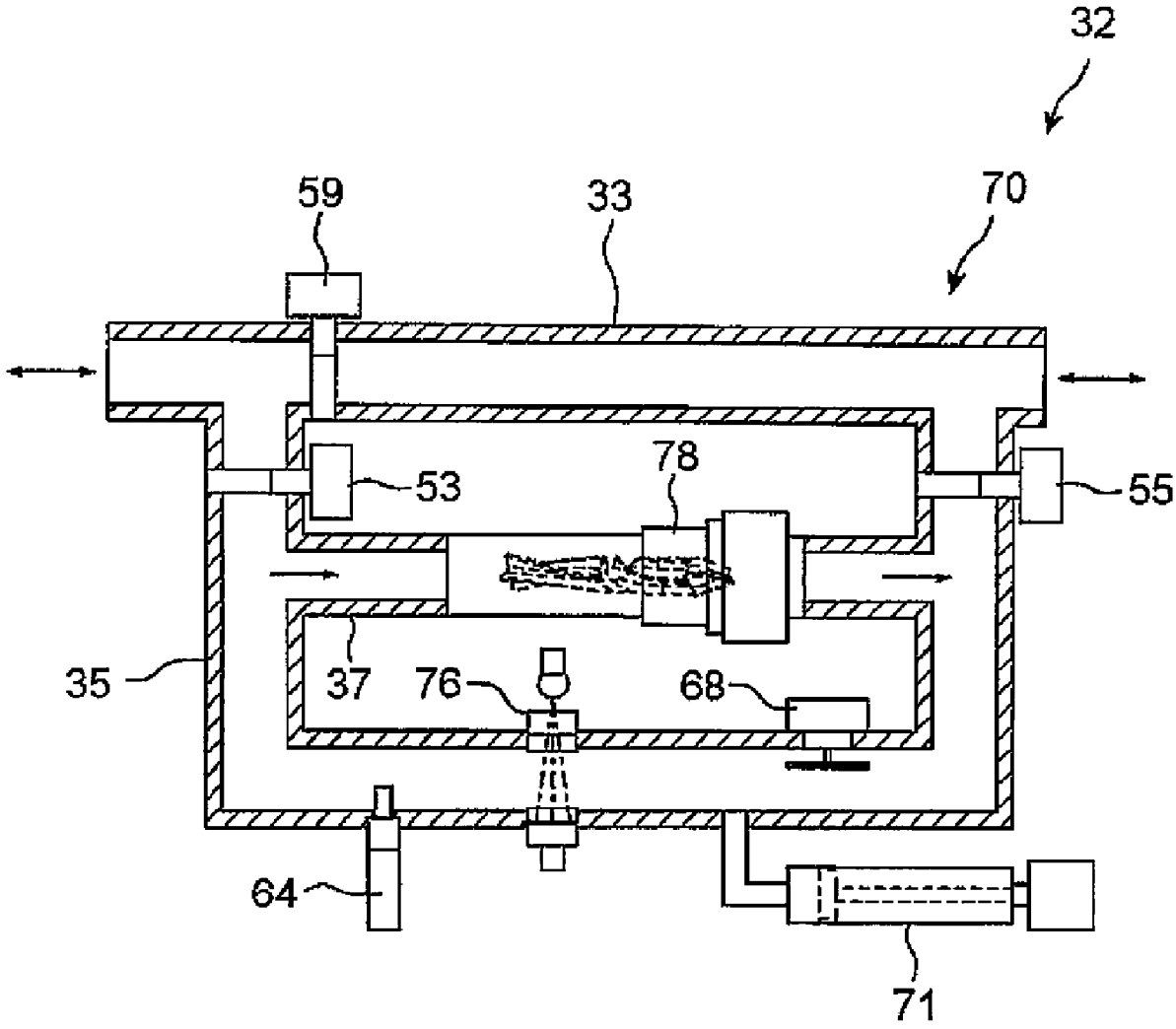
FIG. 7 schematically shows the structure of the fluid analysis module with the PVCU apparatus according to another embodiment in a simplified manner.

FIG. 7 schematically shows the structure of the fluid analysis module 32 with the PVCU apparatus 70 according to an exemplary embodiment in a simplified manner.

During the sampling job, the formation fluids are flowing inside the main flowline 33 while the seal valves 53 and 55 are closed and the seal valve 59 is open. At this time, other fluid analysis modules analyze the characteristics of the sample flowing inside the main flowline 33.

When the sample flow becomes stable, the sample contamination is sufficiently low, and sample is single phase, the sample is collected inside the sampling chamber. After the sample is collected or the user decides to start phase behavior analysis, the seal valve 59 is closed and the seal valves 53 and 55 are opened. Then, the sample flows into the bypass flowline 35 and the circulation flowline 37. After the sample is flowing in the bypass flowline 35 and the circulation flowline 37 for a few minutes, the seal valves 53 and 55 are closed and the seal valve 59 is opened to capture the sample inside the bypass flowline 35 and the circulation flowline 37.

Next, the circulation pump 78 is started while the density and viscosity sensor 68 measures the sample density and the viscosity. The speed of the circulation pump 79 (sample flow rate) can be controlled by the surface positioned software based on the density and the viscosity measured by the density and viscosity sensor 68. Then the PVCU pump unit 71 changes the pressure of the sample captured inside the bypass flowline 35 and the circulation flowline 37 while the pressure/temperature gauge 64 measures the pressure change and the temperature of the sample. The scattering detector 76 monitors the solid (solid precipitation from liquid or oil coming out from condensate) or gas (bubble from liquid) coming out.

Figure 8:
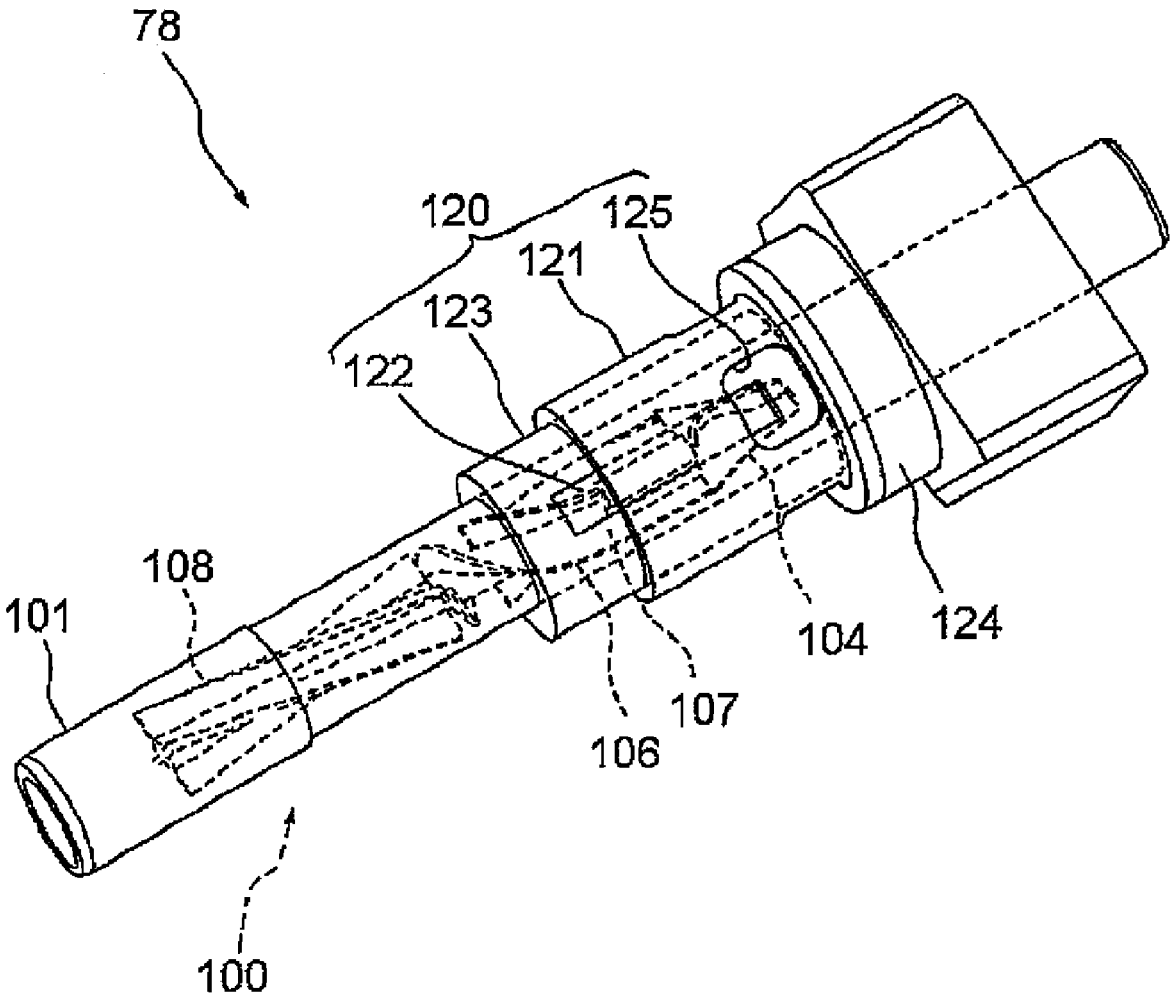
FIG. 8 shows the structure of the circulation pump according to one embodiment of the present invention.

The structure of the circulation pump 78 of one exemplary embodiment will be described with reference to FIGS. 8 to 11. FIG. 8 shows an example of the structure of the circulation pump of the present embodiment. In this embodiment, the circulation pump 78 is an in-line type flow pump which shows low flow impedance at power off condition compared with the conventional linear stroke piston type pump or gear pump. In this embodiment, the circulation pump 78 is located on the circulation flowline 37.

The circulation pump 78 includes an impeller assembly 100, a cylindrical pump housing 101, a magnetic coupler 120, and a motor 124. The impeller assembly 100 is provided in the pump housing 101. The magnetic coupler 120 and the motor 124 are provided outside of the pump housing 101.

The material for forming the pump housing 101 should have resistance for H2S corrosion and other downhole fluid chemical corrosion and erosion as the formation fluid directly contacts the pump housing 101. In addition, the pump housing 101 may be formed of a non-magnetic alloy. The material for the pump housing 101 may be, for example, Ti6Al4V, K-MONEL® (an alloy of nickel, copper, and aluminum) or INCONEL® (a nickel based super alloy). In another case, the pump housing 101 may be formed of a plastic material provided that the material has a sufficient strength and high corrosion resistance.

Figure 9:
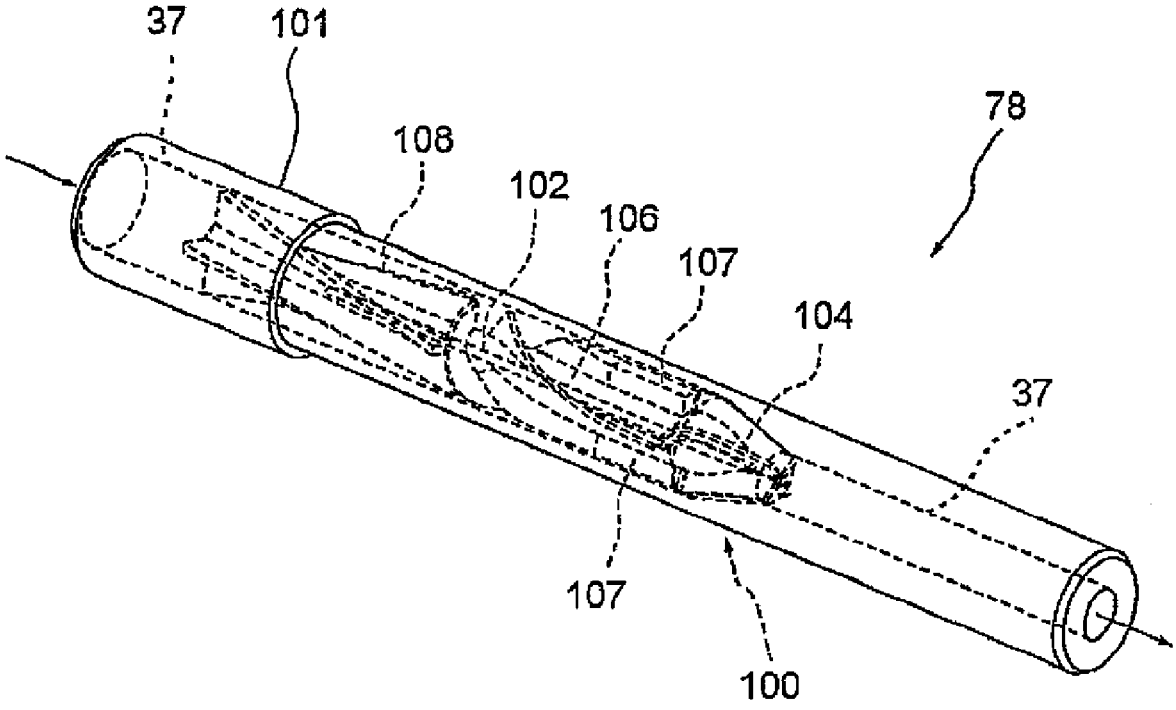
FIG. 9 shows the structure of an impeller assembly of the circulation pump for one embodiment of the present invention.
Figure 10:
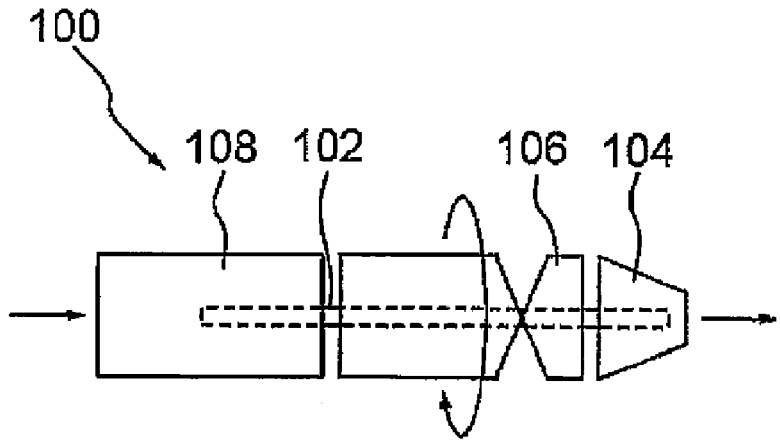
FIG. 10 is a schematic depiction of the structure of the impeller assembly of the circulation pump.

The pump housing 101 defines part of the circulation flowline 37. The pump housing 101 may be formed such that the section where the impeller assembly 100 is placed has a larger diameter than that of the rest of the circulation flowline 37. The structure of the impeller assembly 100 is shown in FIGS. 9 and 10. FIG. 10 schematically shows the structure of the impeller assembly 100 for purposes of the explanation herein.

The impeller assembly 100 includes a shaft 102, a diffuser 104, an impeller 106, a straightener 108, and a magnetic coupler pole piece 107. The diffuser 104, the impeller 106, and the straightener 108 respectively have a central through hole for the shaft 102 to be inserted. The straightener 108 and the diffuser 104 are formed to secure the shaft 102 therein. The straightener 108 and the diffuser 104 are fixed within the pump housing 101 and therefore the shaft 102 is secured within the pump housing 101.

The impeller 106 is formed to be capable of rotating around the shaft 102. The magnetic coupler pole piece 107 is fixed to the impeller 106 such that the piece 107 also rotates around the shaft 102 with the impeller 106.

The impeller 106 and the magnetic coupler pole piece 107 directly contact the formation fluids, and therefore should have high corrosion resistance. The magnetic coupler pole piece 107 may be made from a ferromagnetic material. The magnetic coupler pole piece 107 may be formed of nickel, or an alloy including nickel, or a ferromagnetic material, with a non-corrosive coating such as, for example, gold plating. With this structure, the magnetic coupler pole piece 107 can have high corrosion resistance under high pressure and high temperature. In one example, the impeller 106 and the magnetic coupler pole piece 107 may be separately formed. In such a case, the impeller 106 may be formed of a plastic material, such as, for example, polyetheretherketone (PEEK), or the like. In other examples, the impeller 106 and the magnetic coupler pole piece 107 may be made as one integral part. In such a case, the impeller 106 functions as a part of the magnetic coupler. Therefore, the impeller 106 and the magnetic coupler pole piece 107 may then be made from a ferromagnetic material.

The straightener 108 adjusts the flow of the fluids in the flowline 37. The diffuser 74 also adjusts the flow of the fluids in the flowline 37. The diffuser 74 has a tapered shape such that the fluids in the pump housing 101 having a larger diameter than that of the rest of the circulation flowline 37 are smoothly guided to the rest of the circulation flowline 37.

The shaft 102, the straightener 108 and the diffuser 104 also directly contact the formation fluids, and therefore should have high corrosion resistance. The shaft 102 may be formed of INCONEL® 718, INCONEL® 725, INCONEL® 750, Ti6Al4V, or MONEL® K500. The straightener 108 may be formed of INCONEL® 718, INCONEL® 725, INCONEL® 750, Ti6Al4V, or MONEL® K500, or a plastic material such as, for example, polyetheretherketone (PEEK), or the like. The diffuser 104 may be formed of INCONEL® 718, INCONEL®°725, INCONEL® 750, Ti6Al4V, or MONEL® K500, or a plastic material such as, for example, polyetheretherkctone (PEEK), or the like.

Referring also to FIG. 8, the circulation pump 78 of this exemplary embodiment is a direct drive type circulation pump. The pump 78 uses a hollow axle stepping motor to directly rotate the magnetic coupler 120. The magnetic coupler 120 and the motor 124 respectively have a central hole through which the pump housing 101 is inserted. The pump housing 101 is inserted into the center hole of the magnetic coupler 120 and the motor 124. The magnetic coupler 120 is connected with the rotor of the motor 124 via screws or the like. The magnetic coupler 120 includes a pair of magnets 122 (only one magnet is shown here), a cylindrical magnetic rotary transmitter 121, and a fixing portion 123 that fixes the magnets 122 inside the rotary transmitter 121. The fixing portion 123 is formed into a cylindrical shape with a central through hole through which the pump housing 101 is inserted. The cylindrical magnetic rotary transmitter 121 may be formed of ferromagnetic material in this embodiment. The transmitter 121 is formed with a window 125 that is provided for reducing the weight of the transmitter 121 and for attaching the transmitter 121 to the motor 124.

Figure 11:
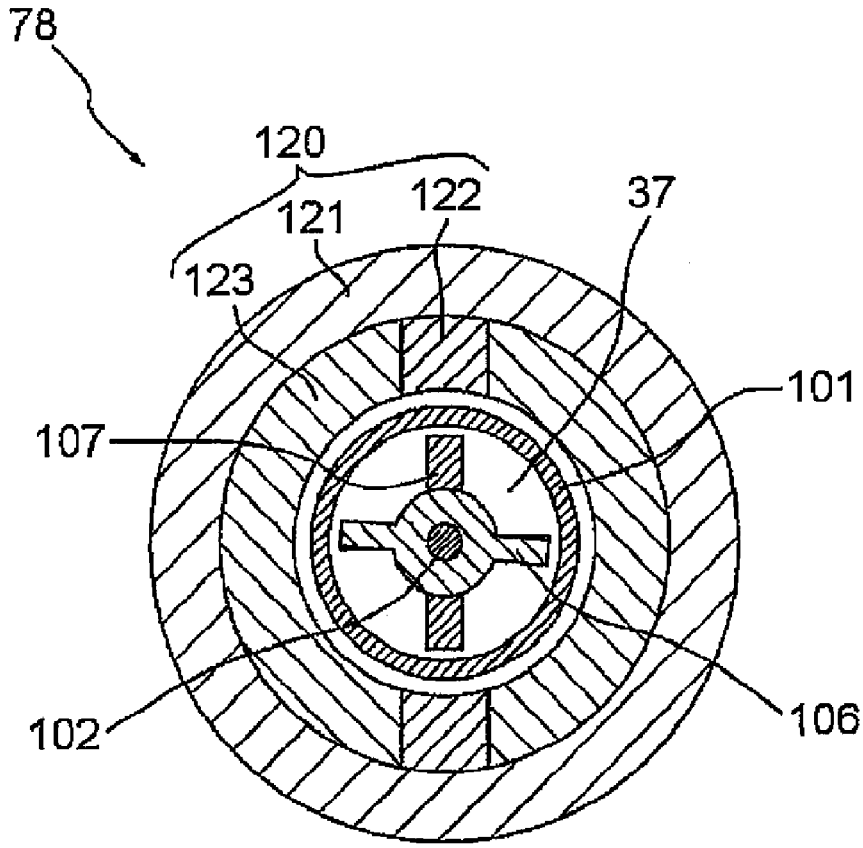
FIG. 11 schematically shows a cross sectional view of the circulation pump showing the pump housing, the impeller, the shaft, and the magnetic coupler.

FIG. 11 schematically shows the cross sectional view of the circulation pump 78 showing the pump housing 101, the impeller 106, the shaft 102, and the magnetic coupler 120.

The magnetic coupler 120 has a cylindrical shape and a central through hole. A pair of magnets 122 of the magnetic coupler 120 are shown. The fixing portion 123 fixes the magnets 122 inside the rotary transmitter 121 to form the through hole. The fixing portion 123 fixes the pair of magnets 122 to face each other with the through hole interposed therebetween.

The magnets 122 may be permanent magnets. These magnets 122 may be rare earth magnets such as samarium magnets or neodymium magnets, as typified by SmCo5, Nd2Fe14B, and Sm2Co17. In this embodiment, the magnets 122 may be SmCo5 type magnets. By using this material, the magnets 122 can tolerate high temperature conditions.

The cylindrical rotary transmitter 121 may be formed of steel. The transmitter 121 is connected to the motor 124 to be rotated by the motor 124. The magnets 122 are fixed inside the transmitter 121 by the fixing portion 123. The fixing portion 123 may be formed of a resin material such as PEEK™ (polyetheretherketone). The fixing portion 123 may be formed into a cylindrical shape having a through hole at its center with the magnets 122 fit therein to face each other. As for the structure of the present embodiment, as the magnets 122 are surrounded by the cylindrical ferromagnetic rotary transmitter 121, the magnetic force is sealed within the transmitter 121 and the magnetic force is effectively transmitted from the magnets 122 to the magnetic coupler pole pieces 107. Thus, a sufficient magnetic force can be obtained even when viscosity of the formation fluids is high.

The impeller assembly 100 may include a pair of the magnetic coupler pole pieces 107 such that the pieces 107 respectively face the pair of the magnets 122 with the pump housing 101 interposed therebetween when the pump housing 101 is inserted in the through hole of the magnetic coupler 120.

Referring also to FIGS. 8-10, the rotator of the motor 124 can rotate the magnetic coupler 120 around the pump housing 101. In this embodiment, the rotator of the motor 124 itself rotates around the pump housing 101. This structure can minimize the size of the circulation pump 78. The rotation speed of the motor 124 is selected to be more than 15,000 rpm to provide enough flow, as will be explained later.

When the magnetic coupler 120 rotates around the pump housing 101, the impeller 106 also rotates around the shaft 102 as the pieces 107 fixed to the impeller 106 follow the movement of the magnets 122, respectively. It means that the magnetic coupler 120 is magnetically coupled to the impeller 106. The motor 124 can rotate the impeller 106 from outside the circulation Bowline 37 without being directly connected to the impeller 106. Rotation force is generated by the motor 124 which has no electrical feedthrough connection between the inside and the outside of the pump housing 101. Motor torque is transferred to the impeller 106 through the magnetic coupler 120. Therefore, the motor 124 can be placed outside the circulation flowline 37. Thus, the motor 124 does not need a dynamic pressure seal, and the pump size and dead volume can be reduced. Furthermore, even when the circulation pump 78 is not operated, fluids can pass through the circulation flowline 37. Therefore, the circulation pump 78 (i.e., the components inside and outside the circulation flowline 37) can be cleaned and maintained easily.

The force of the magnetic coupler 120 has an exponential relation to the pole (pole pieces 107) to magnet (magnets 122) gap that is the thickness of the pump housing 101. Therefore, the pump housing 101 should have minimum thickness that is required to support the internal pressure generated in the pump housing 101. For example, the thickness of the pump housing 101 may be about 3 mm when the pump housing 101 is formed of Ti6Al4V.

The circulation pump 78 works as an agitator to mix the sample inside the circulation flowline 37 and to create bubbles or solids inside the circulation flowline 37. With this function of the circulation pump 78, bubbles and solids that are generated are carried to the scattering detector 76. The pressure value is recorded when the scattering detector 76 detects the bubbles or solids. The flow speed in the circulation flowline 37 depends on the performance of the circulation pump 78 and the viscosity of the sample. The circulation pump 78 can generate enough flow to carry a sample having a high viscosity, as much as 10 cP, to the scattering detector 76.

Figure 12:
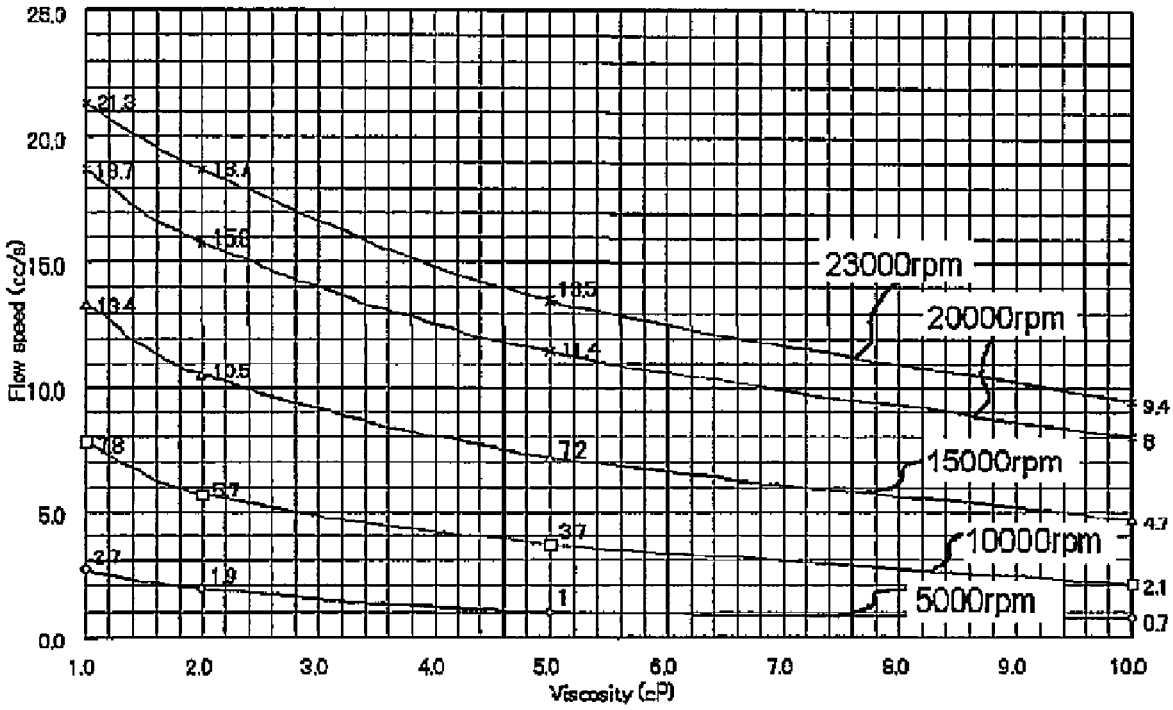
FIG. 12 shows a relation between the flow speed that is generated by the circulation pump and the viscosity of the sample.

FIG. 12 shows a relation between the flow speed that is generated by the circulation pump 78 and the viscosity of the sample. The flow speed is strongly related with the rotation speed of the impeller 106 and the viscosity of the sample. It is considered that more than 4 cc/s of the flow speed is suitable to measure the bubble point of a sample having any viscosity in the apparatus 32 of the present embodiment. In order to provide 4 cc/s of the flow speed, the motor 124 may be selected so that the impeller 106 is rotated, via the magnetic coupling, by more than 15,000 rpm. In this embodiment, the impeller 106 is rotated at the same speed as the rotator of the motor 124 rotates. Therefore, the motor 124 whose rotation speed is more than 15,000 rpm may be utilized.

The distance between the circulation pump 78 and the scattering detector 76 needs to be selected so as to be very small so that pressure measurement error is minimized. Since the circulation pump 78 carries bubbles and solids to the scattering detector 76 for bubble point measurements, the distance between the circulation pump and the scattering detector should be set to be as small as possible so that the time delay is minimized in the response of the scattering detector for accurate measurements of bubble point. The PVCU pump unit 70 changes the volume of the captured sample in the flowlines 35 and 37 to change the pressure of the sample. The PVCU pump unit 70 needs to have enough stroke of the piston to change the pressure. By minimizing dead volume of the circulation pump 78, it is possible to minimize the PVCU pump unit 70.

The circulation pump 78 of the present embodiment may be configured to be small, with a small dead volume, and to be driven by the magnetically coupled motor 124.

Figure 13:
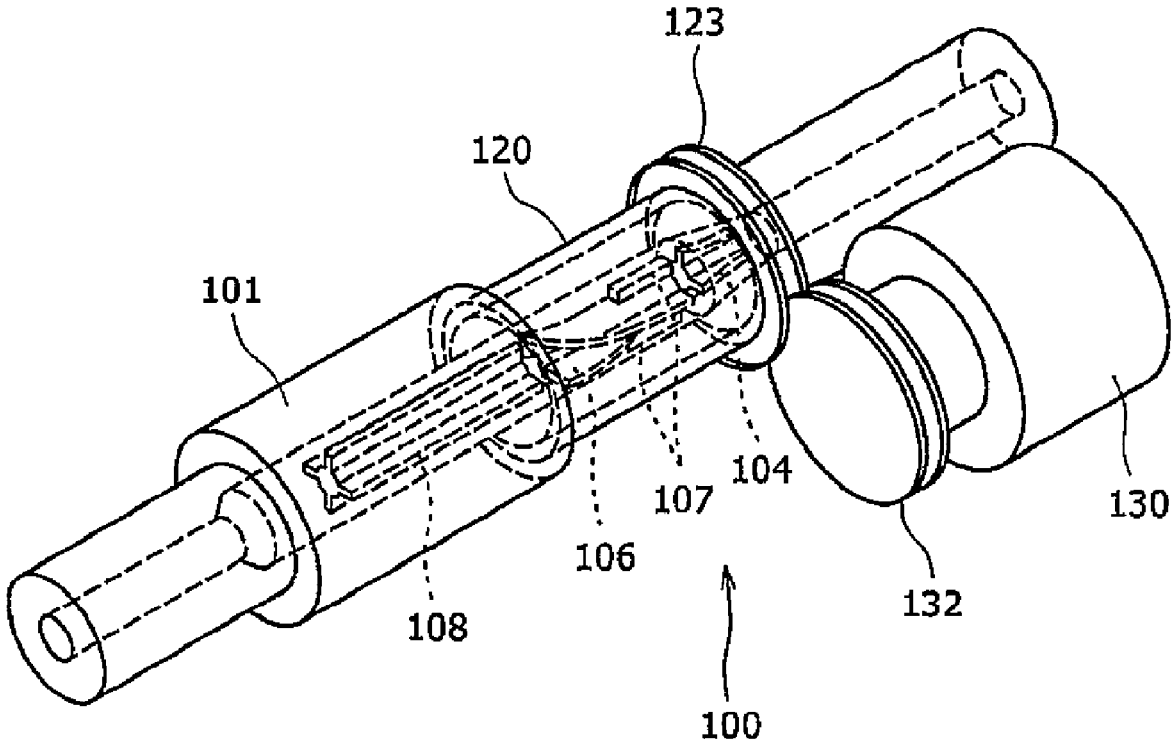
FIG. 13 shows the structure of the circulation pump for another embodiment of the present invention.

FIG. 13 shows another example of the structure of the circulation pump 78. In this example, the circulation pump 78 is a timing belt drive circulation pump. In this example, the magnetic coupler 120 and the motor 130 are connected with a timing belt (not shown). This pump uses a high rotation speed brushless motor with the timing belt that functions as a rotary transmitter to rotate the magnetic coupler 120.

The magnetic coupler 120 includes a pulley 123. Another pulley 132 is fixed to the motor 130. The timing belt is engaged in the grooves of the pulleys 123 and 132 such that the rotation of the pulley 132 is transmitted to the pulley 123 to rotate the magnetic coupler 120. Additionally, the pump housing 101, in which the impeller assembly 100 is placed, is inserted into the center hole of the magnetic coupler 120. Thus, the impeller 106 can rotate around the shaft (not shown here). The brushless motor 130 can generate more than 15,000 rpm of rotation speed. With this structure, higher rotation speed can be provided to the pump, for example, by adjusting the diameters of the pulleys 123 and 132, respectively. Further, one or more pulley (not shown) may be provided between the pulleys 123 and 132. With this structure, the rotation speed of the pump can be selectively adjusted by adjusting the diameter of the pulleys. In this embodiment, instead of the pulleys 123 and 132, gears, including cogged gears and friction gears, may be used as well (not shown).

Figure 14:
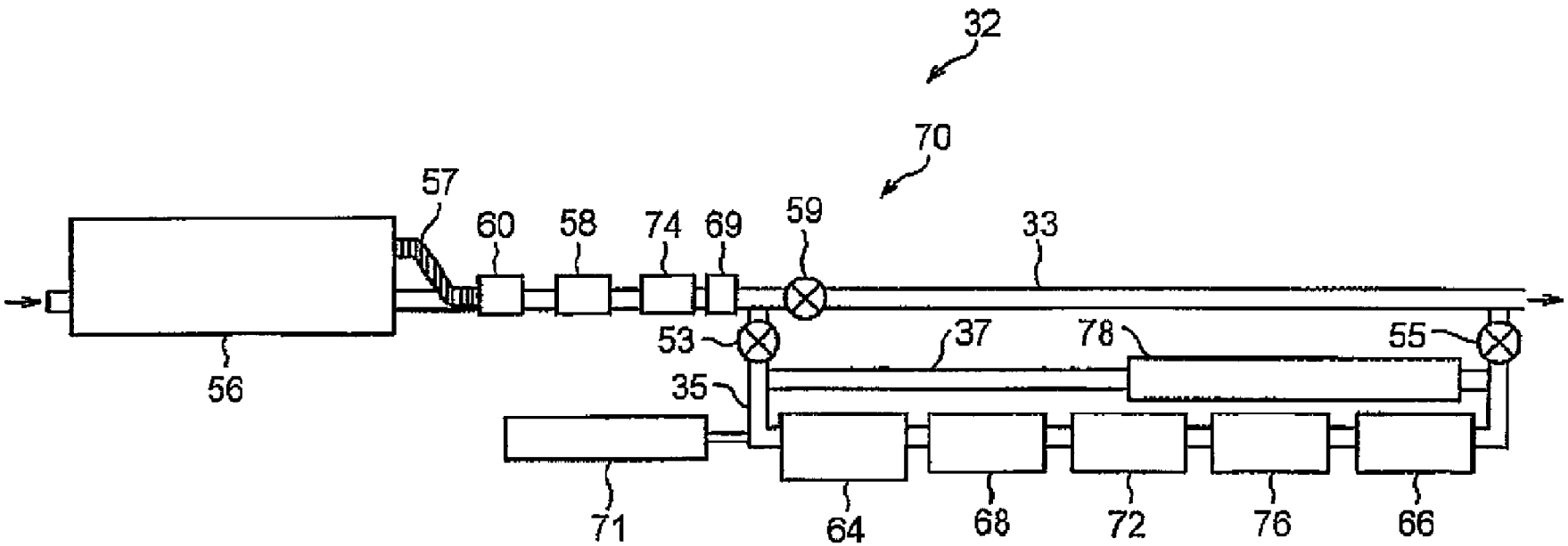
FIG. 14 schematically represents yet another embodiment of a fluid analysis module according to the present invention.
Figure 15:
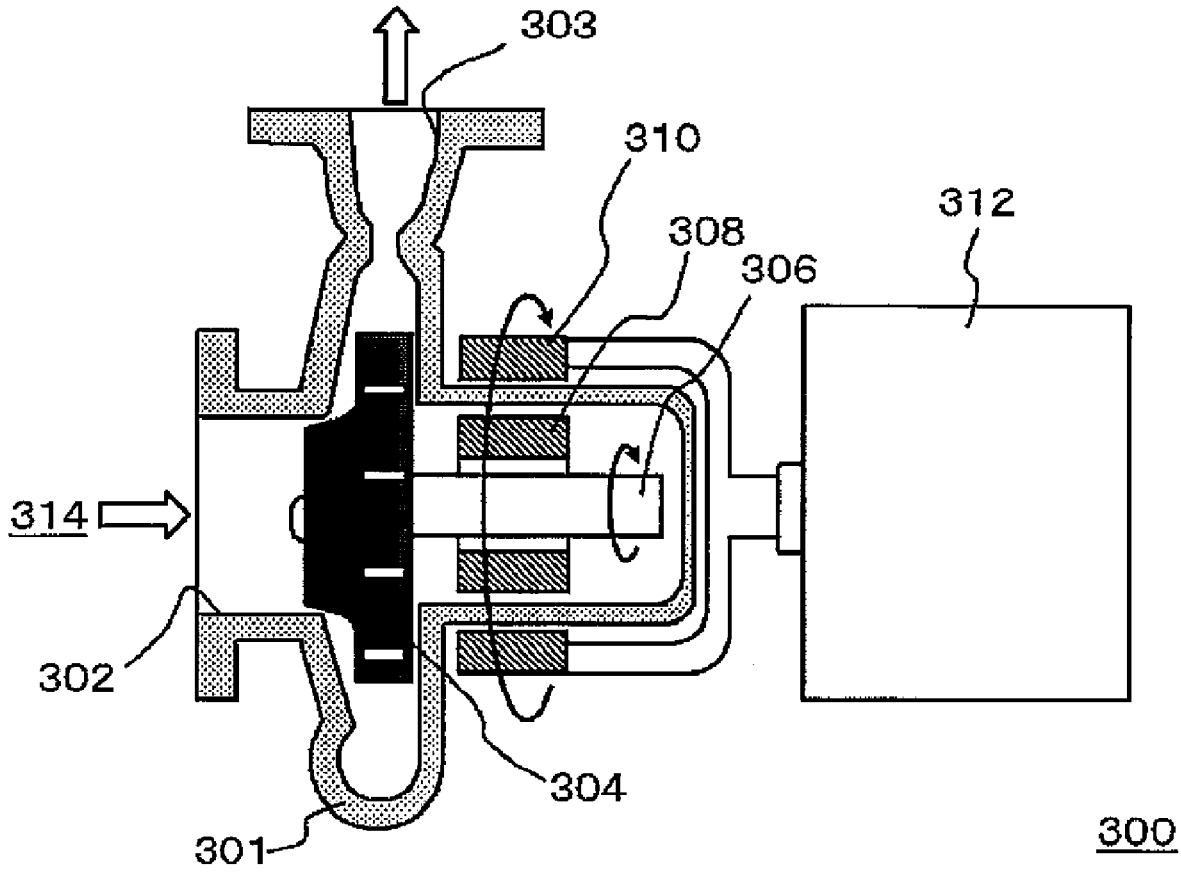
Fig. 15 PRIOR ART
FIG. 15 shows an example of the structure of a conventional centrifuge magnetic coupling pump.

FIG. 14 schematically represents yet another embodiment of a fluid analysis module 32 according to the present invention. The apparatus 70 depicted in FIG. 14 is similar to the embodiment in FIG. 4 with a bypass flowline 35 and a circulation flowline 37 in fluid communication, via main flowline 33, with a formation surrounding a borehole. The apparatus 70 of FIG. 14 includes two valves 53 and 55 operatively associated with the bypass flowline 35. The valves 53 and 55 are situated so as to control the flow of formation fluids in the bypass flowline segment 35 of the main flowline 33 and to isolate formation fluids in the bypass flowline 35 between the two valves 53 and 55. A valve 59 may be situated on the main flowline 33 to control fluid flow in the main flowline 33.

The apparatus 70 depicted in FIG. 14 is similar to the apparatus depicted in FIG. 4 except that one or more optical sensors, such as a 36-channels optical spectrometer 56, connected by an optical fiber bundle 57 with an optical cell or refractometer 60, and/or a fluorescence/refraction detector 58, may be arranged on the main flowline 33, instead of the bypass flowline 35 as depicted in FIG. 4. The optical sensors may be used to characterize fluids that are flowing through the main flowline 33 since optical sensor measurements do not require an isolated, static fluid. Instead of the arrangement depicted in FIG. 4, a resistance sensor 74 and a chemical sensor 69 also may be provided on the main flowline 33 in the embodiment of FIG. 14 to acquire fluid electrical resistance and chemical measurements with respect to fluids flowing in the main flowline 33.

Although a single set of the impeller 106, the magnetic coupler 120 and the motor 124 (or 130) is described in the above embodiments, the circulation pump 78 may include a plurality of sets of the impeller 106, the magnetic coupler 120, and the motor 124 (or 130). The plurality of magnetic couplers 120 are respectively provided around the plurality of impellers 106. The circulation pump 78, for example, may include one set of the diffuser 104 and the straightener 108. In this example, the plurality of impellers 106 may be placed in series between the diffuser 104 and the straightener 108. As for another example, the circulation pump 78 may further include a plurality of sets of the diffuser 104 and the straightener 108 in addition to the plurality of sets of the impeller 106, the magnetic coupler 120, and the motor 124 (or 130). It means that the circulation pump 78 includes the plurality of sets of the straightener 108, the impellers 106, and the diffuser 104. In this example, each of the sets of the straightener 108, the impellers 106, and the diffuser 104, placed in this order, is placed in series. With the structure where the plurality of sets of the impeller 106, the magnetic coupler 120, and the motor 124 (or 130) are provided, the circulation pump 78 can provide appropriate flow speed to the fluids in the flowlines 35 and 37.

Although the impeller 106 and the shaft 102 are formed separately in the above embodiments, the impeller 106 and the shaft 102 may be formed as one part.

In addition, although the case where the magnetic coupler 120 includes a pair of magnets 122 is shown in the above embodiments, the magnetic coupler 120 may include a plurality of magnets fixed inside the cylindrical magnetic rotary transmitter 121. In this case, the plurality of magnets may be provided around the central through hole of the magnetic coupler 120 with predetermined equal intervals. In addition, the magnetic coupler pole piece 107 provided to the impeller 106 may be formed of a plurality of magnetic members. Each of the plurality of magnetic members may be provided to face each of the plurality of magnets of the magnetic coupler 120, respectively, when the pump housing 101 is inserted in the magnetic coupler 120.

A density sensor may measure density of the isolated formation fluid. A MEMS, for example, may measure density and/or viscosity and a P/T gauge may measure pressure and temperature. A chemical sensor may detect various chemical properties of the isolated formation fluid, such as CO2, H2S, pH, among other chemical properties.

The preceding description has been presented only to illustrate and describe the invention and some examples of its implementation. It is not intended to be exhaustive or to limit the invention to any precise form disclosed. Many modifications and variations are possible in light of the above teaching. The preferred aspects were chosen and described in order to best explain principles of the invention and its practical applications. The preceding description is intended to enable others skilled in the art to best utilize the invention in various embodiments and aspects and with various modifications as are suited to the particular use contemplated. It is intended that the scope of the invention be defined by the following claims.

What is claimed is:

1. A fluid pump structured to circulate at least one downhole fluid through a fluid circulating flow line, the fluid pump comprising:

(a) a rotatable impeller located in the flow line that does not obstruct a fluid flow in the flow line and which serves to impel the fluid when it is caused to rotate;

(b) a magnetic coupler located around the flow line and magnetically coupled to rotate the impeller when it is rotated; and (c) a motor drive coupled to the magnetic coupler to rotate the magnetic coupler and thereby, the impeller.

2. The fluid pump according to claim 1 further comprising:

a cylindrical pump housing through which the at least one fluid flows in a longitudinal direction thereof;

and a shaft secured within the cylindrical pump housing extending in the longitudinal direction thereof, wherein the rotatable impeller further comprises a first central through hole, the shaft being inserted through the first central through hole, the rotatable impeller being configured to rotate round the shaft within the cylindrical pump housing;

wherein the magnetic coupler further comprises a magnet and a second central through hole, the cylindrical pump housing being inserted through the second central through hole and the magnetic coupler being configured to rotate around the cylindrical pump housing, wherein the motor drive is positioned outside of the cylindrical pump housing and connected to the magnetic coupler to rotate the magnetic coupler around the cylindrical pump housing, and wherein the rotatable impeller further comprises a magnetic piece which is capable of being magnetically connected with the magnet of the magnetic coupler to cause the impeller to rotate around the shaft by rotating the magnetic coupler around the cylindrical pump housing.

3. The fluid pump according to claim 2, wherein the magnet of the magnetic coupler is a permanent magnet.

4. The fluid pump according to claim 2, wherein the magnet of the magnetic coupler is a rare earth magnet.

5. The fluid pump according to claim 2, wherein the magnet of the magnetic coupler is formed of one of samarium magnets and neodymium magnets.

6. The fluid pump according to claim 2, wherein the magnetic coupler includes a cylindrical magnetic rotary transmitter connected to the motor drive to be rotated by the motor drive, and wherein the magnet is secured inside the cylindrical magnetic rotary transmitter.

7. The fluid pump according to claim 6, wherein the cylindrical magnetic rotary transmitter is formed of a ferromagnetic material.

8. The fluid pump according to claim 6, wherein the magnet of the magnetic coupler comprises a plurality of magnets secured inside the cylindrical magnetic rotary transmitter, the plurality of magnets being provided around the second central through hole.

9. The fluid pump according to claim 8, wherein the magnetic piece of the rotatable impeller comprises a plurality of magnetic members, each of the plurality of magnetic members being configured to face one of the plurality of magnets of the magnetic coupler when the cylindrical pump housing is inserted into the magnetic coupler.

10. The fluid pump according to claim 2, wherein the cylindrical pump housing is formed of a non magnetic alloy.

11. The fluid pump according to claim 10, wherein the cylindrical pump housing is formed of Ti6Al4V.

12. The fluid pump according to claim 1, wherein the rotatable impeller is configured and arranged for agitating a fluid in the flow line.

13. A downhole apparatus comprising:

a fluid analyzer configured to analyze at least one downhole fluid;

a fluid circulating flow line coupled to and structured to circulate the at least one fluid through the fluid analyzer; and a fluid pump structured for circulating the at least one fluid through the fluid circulation flow line, wherein the fluid pump includes:

(a) a rotatable impeller in the flow line which does not obstruct the fluid flow in the flow line and which serves to impel the fluid when it is caused to rotate;

(b) a magnetic coupler located around thc flow line and magnetically coupled to rotate the impeller when it is rotated; and (c) a motor drive coupled to the magnetic coupler to rotate the magnetic coupler and thereby, the impeller.

14. The downhole apparatus according to claim 13, wherein the fluid circulating flow line includes a first end for the at least one fluid to enter and a second end for the at least one fluid to exit the fluid analyzer, wherein a first selectively operable device and a second selectively operable device are arranged with respect to the fluid circulating flow line to isolate a quantity of the at least one fluid in a portion of the fluid circulating flow line between the first and the second selectively operable devices, the portion of the fluid circulating flow line isolating the quantity of the at least one fluid including a bypass flow line and a circulation flow line, the first and the second selectively operable devices being configured to isolate the fluids in the bypass flow line, and the circulation flow line interconnecting a first end of the bypass flow line with a second end of the bypass flow line such that the at least one fluid isolated between the first and the second selectively operable devices can circulate in a closed loop formed by the circulation flow line and the bypass flow line;

wherein the fluid pump further includes a cylindrical pump housing through which the at least one fluid flows in a longitudinal direction thereof; and a shaft secured within the cylindrical pump housing extending in the longitudinal direction thereof, wherein the rotatable impeller further comprises a first central through hole, the shaft being inserted through the first central through hole, the rotatable impeller being configured to rotate around the shaft within the cylindrical pump housing;

wherein the magnetic coupler further comprises a magnet and a second central through hole, the cylindrical pump housing being inserted through the second central through hole and the magnetic coupler being configured to rotate around the cylindrical pump housing, wherein the motor drive is positioned outside of the cylindrical pump housing and connected to the magnetic coupler to rotate the magnetic coupler wound the cylindrical pump housing, wherein the rotatable impeller further comprises a magnetic piece which is capable of being magnetically connected with the magnet of the magnetic coupler to cause the impeller to rotate around the shaft by rotating the magnetic coupler around the cylindrical pump housing; and wherein the downhole apparatus further comprises at least one sensor situated on the closed loop of the circulation flow line and the bypass flow line for measuring desired parameters of the at least one fluid in the fluid circulating flow line.

15. The downhole apparatus according to claim 14, wherein the rotatable impeller is configured and arranged for agitating a fluid in the flow line.

16. The downhole apparatus according to claim 14, wherein the at least one sensor comprises a scattering detector; and wherein the fluid pump is situated at a distance from the scattering detector so that the time delay in fluid from the fluid pump reaching the scattering detector is minimized.

17. The downhole apparatus according to claim 14, wherein the cylindrical pump housing of the fluid pump forms a part of the circulation flow line.

18. A downhole apparatus comprising:

a fluid analyzer configured to analyze at least one downhole fluid, wherein the fluid analyzer further comprises a pump unit for varying pressure and volume of the isolated at least one fluid;

a fluid circulating flow line coupled to and structured to circulate the at least one fluid through the fluid analyzer, wherein the fluid circulating flow line includes a first end for the at least one fluid to enter and a second end for the at least one fluid to exit the fluid analyzer;

a fluid pump structured for circulating the at least one fluid through the fluid circulation flow line, wherein the fluid pump includes:

(a) a cylindrical pump housing through which the at least one fluid flows in a longitudinal direction thereof, (b) a shaft secured within the cylindrical pump housing extending in the longitudinal direction thereof, (c) a rotatable impeller in the flow line which does not obstruct the fluid flow in the flow line and which serves to impel the fluid when it is caused to rotate, wherein the rotatable impeller further comprises a first central through hole, the shaft being inserted through the first central through hole, the rotatable impeller being configured to rotate wound the shaft within the cylindrical pump housing;

(d) a magnetic coupler located outside the flow line and magnetically coupled to rotate the impeller when it is rotated, wherein the magnetic coupler further comprises a magnet and a second central through hole, the cylindrical pump housing being inserted through the second central through hole, and a magnetic piece being provided for the rotatable impeller and is capable of being magnetically connected with the magnet of the magnetic coupler to cause the impeller to rotate around the shaft by rotating the magnetic coupler around the cylindrical pump housing, (e) a motor drive coupled to the magnetic coupler to rotate the magnetic coupler and thereby, the impeller, wherein the motor drive is positioned outside of the cylindrical pump housing and connected to the magnetic coupler to rotate the magnetic coupler around the cylindrical pump housing, a first selectively operable device and a second selectively operable device arranged with respect to the fluid circulating flow line to isolate a quantity of the at least one fluid in a portion of the fluid circulating flow line between the first and the second selectively operable devices, the portion of the fluid circulating flow line isolating the quantity of the at least one fluid including a bypass flow line and a circulation flow line, the first and the second selectively operable devices being configured to isolate the fluids in the bypass flow line, and the circulation flow line interconnecting a first end of the bypass flow line with a second end of the bypass flow line such that the at least one fluid isolated between the first and the second selectively operable devices can circulate in a closed loop formed by the circulation flow line and the bypass flow line; and at least one sensor situated on the closed loop of the circulation flow line and the bypass flow line for measuring desired parameters of the at least one fluid in the fluid circulating flow line.

19. The downhole apparatus according to claim 18, wherein the fluid analyzer further comprises a scattering detector for detecting a bubble point of isolated fluids while pressure and volume of the isolated fluids is varied by the pump unit.

20. The downhole apparatus according to claim 14, wherein the magnet of the magnetic coupler comprises a magnet selected from the group consisting of a permanent magnet, a rare earth magnet, a samarium magnet and a neodymium magnet.

21. The downhole apparatus according to claim 14, wherein the magnetic coupler includes a cylindrical magnetic rotary transmitter that is connected for rotation to the motor drive, and wherein the magnet is secured inside the cylindrical magnetic rotary transmitter.

22. The downhole apparatus according to claim 21, wherein the cylindrical magnetic rotary transmitter is formed of a ferromagnetic material.

23. The downhole apparatus according to claim 21, wherein the magnet of the magnetic coupler comprises a plurality of magnets secured inside the cylindrical magnetic rotary transmitter, the plurality of magnets being positioned around the second central through hole.

24. The downhole apparatus according to claim 23, wherein the magnetic piece of the rotatable impeller comprises a plurality of magnetic members, each of the plurality of magnetic members facing one of the plurality of magnets of the cylindrical magnetic coupler when the cylindrical pump housing is inserted into the magnetic coupler.

25. A method of characterization of downhole fluids utilizing a downhole tool comprising a fluid analysis module having a flowline for flowing downhole fluids through the fluid analysis module and a circulation pump for circulating downhole fluids, the method comprising:

monitoring at least a first desired parameter of downhole fluids flowing in the flowline;

when a predetermined criterion for the first desired parameter is satisfied, restricting flow of the downhole fluids in the flowline by operation of a first selectively operable device and a second selectively operable device of the fluid analysis module to isolate downhole fluids in a portion of the flowline of the fluid analysis module between the first and the second selectively operable devices;

characterizing the isolated fluids by operation of at least one sensor on the flowline between the first and the second selectively operable devices; and circulating the isolated fluids in a closed loop of the flowline using the circulation pump while characterizing the isolated fluids, the circulation pump including a cylindrical pump housing through which the isolated fluids flow in a longitudinal direction thereof; a shaft secured in the cylindrical pump housing extending in the longitudinal direction of the cylindrical pump housing; an impeller having a central through hole with the shaft inserted therethrough and configured to rotate around the shaft in the cylindrical pump housing; a cylindrical magnetic coupler having a central through hole with the cylindrical pump housing inserted therethrough and configured to rotate around the cylindrical pump housing, the cylindrical magnetic coupler including a magnet; and a motor positioned outside of the cylindrical pump housing and connected to the magnetic coupler to rotate the magnetic coupler around the cylindrical pump housing, wherein the impeller comprises a magnetic piece which is capable of being magnetically connected with the magnet of the cylindrical magnetic coupler to cause the impeller to rotate around the shaft by rotating the cylindrical magnetic coupler around the cylindrical pump housing.

* * * * *